US010722996B2

(12) United States Patent
Bianchi et al.

(10) Patent No.: US 10,722,996 B2
(45) Date of Patent: Jul. 28, 2020

(54) AIRFOIL MACHINE COMPONENTS POLISHING METHOD

(71) Applicant: Nuovo Pignone Srl, Florence (IT)

(72) Inventors: Lorenzo Bianchi, Florence (IT); Lorenzo Lorenzi, Florence (IT); Ferruccio Petroni, Florence (IT); Paolo Mola, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 602 days.

(21) Appl. No.: 15/029,798

(22) PCT Filed: Oct. 14, 2014

(86) PCT No.: PCT/EP2014/071939
§ 371 (c)(1),
(2) Date: Apr. 15, 2016

(87) PCT Pub. No.: WO2015/055601
PCT Pub. Date: Apr. 23, 2015

(65) Prior Publication Data

US 2016/0229022 A1 Aug. 11, 2016

(30) Foreign Application Priority Data

Oct. 17, 2013 (IT) ..... FI2013A0248

(51) Int. Cl.
*B24B 31/06* (2006.01)
*B24B 1/04* (2006.01)
(Continued)

(52) U.S. Cl.
CPC ..... *B24B 31/06* (2013.01); *B24B 1/04* (2013.01); *B24B 19/14* (2013.01); *B24B 31/064* (2013.01);
(Continued)

(58) Field of Classification Search
CPC ..... B24B 1/04; B24B 19/14; B24B 31/06; B24B 31/064; B24C 1/10; F05D 2230/90; F05D 2250/621
See application file for complete search history.

(56) References Cited

U.S. PATENT DOCUMENTS 3,161,997 A * 12/1964 Balz ..... B24B 31/06 451/35
3,248,826 A * 5/1966 Van Fossen ..... B24B 31/06 366/128
(Continued)

FOREIGN PATENT DOCUMENTS

EP 1 219 389 A1 7/2002
EP 1219389 A1 7/2002
(Continued)

OTHER PUBLICATIONS

Notification of Reasons for Refusal issued in connection with corresponding JP Application No. 2016-522758 dated Sep. 4, 2018 (English Translation Unavailable).
(Continued)

*Primary Examiner* — Timothy V Eley
(74) *Attorney, Agent, or Firm* — Baker Hughes Patent Organization

(57) ABSTRACT

A polishing method is described for polishing a machine component comprising at least one airfoil portion comprised of a suction side, a pressure side, a leading edge and a trailing edge. The method provides for arranging the machine component in a container and constraining the machine component to the container. A polishing mixture is added in the container, and the container is caused to vibrate together with the machine component constrained thereto, thereby generating a polishing mixture flow along the airfoil portion until a final arithmetic average roughness is achieved.

28 Claims, 18 Drawing Sheets

(51) Int. Cl.

| | |
|---|---|
| ***B24B 19/14*** | (2006.01) |
| ***B24C 1/10*** | (2006.01) |
| ***F01D 5/14*** | (2006.01) |
| ***F01D 9/04*** | (2006.01) |
| ***F04D 29/28*** | (2006.01) |
| ***F04D 29/32*** | (2006.01) |
| ***F04D 29/54*** | (2006.01) |
| ***F04D 29/02*** | (2006.01) |

(52) U.S. Cl.

CPC ..... *B24C 1/10* (2013.01); *F01D 5/147* (2013.01); *F01D 9/041* (2013.01); *F04D 29/023* (2013.01); *F04D 29/284* (2013.01); *F04D 29/324* (2013.01); *F04D 29/542* (2013.01); *F01D 5/141* (2013.01); *F05D 2230/90* (2013.01); *F05D 2250/621* (2013.01); *F05D 2300/516* (2013.01)

(56) References Cited

U.S. PATENT DOCUMENTS

| | | | | | |
|---|---|---|---|---|---|
| 3,680,266 | A * | 8/1972 | Shiplov | B24B 31/06 | 366/112 |
| 3,774,888 | A * | 11/1973 | Isaacson | B07B 1/02 | 366/108 |
| 4,499,692 | A * | 2/1985 | Balz | B24B 31/06 | 451/32 |
| 4,652,469 | A * | 3/1987 | Hiller | B24B 31/14 | 427/289 |
| 4,716,684 | A * | 1/1988 | Roach | B24B 31/064 | 451/104 |
| 4,823,513 | A * | 4/1989 | Marcus | B24B 31/064 | 134/1 |
| 5,375,377 | A * | 12/1994 | Kenton | B24B 31/06 | 451/22 |
| 5,384,989 | A * | 1/1995 | Shibano | B24B 1/04 | 451/104 |
| 6,261,154 | B1 * | 7/2001 | McEneny | B24B 29/02 | 451/32 |
| 6,688,953 | B2 * | 2/2004 | Kawasaki | B24B 1/00 | 451/106 |
| 6,764,384 | B1 * | 7/2004 | Kleer | B24B 31/064 | 451/104 |
| 6,817,051 | B2 * | 11/2004 | Tanner | B24B 19/14 | 15/1.7 |
| 7,014,533 | B2 | 3/2006 | Bolz et al. | | |
| 9,057,272 | B2 * | 6/2015 | Cheah | B24B 31/06 | |
| 9,463,548 | B2 * | 10/2016 | Versluys | B24B 31/06 | |
| 10,166,651 | B2 * | 1/2019 | Tian | B24B 31/064 | |
| 2004/0043231 | A1 | 3/2004 | Tanner | | |
| 2004/0097170 | A1 * | 5/2004 | Bolz | B24B 1/00 | 451/36 |
| 2007/0107217 | A1 * | 5/2007 | Baus | B24B 31/064 | 29/889.1 |
| 2008/0241370 | A1 * | 10/2008 | Topa | B24B 31/00 | 427/142 |
| 2009/0235526 | A1 | 9/2009 | Secherling et al. | | |
| 2010/0287772 | A1 * | 11/2010 | Hennig | B24B 31/06 | 29/889 |
| 2011/0256809 | A1 * | 10/2011 | Baudimont | B24B 31/003 | 451/36 |
| 2015/0251291 | A1 * | 9/2015 | Hovik | B24B 31/06 | 451/35 |
| 2017/0361422 | A1 * | 12/2017 | Brand | B24C 1/08 | |

FOREIGN PATENT DOCUMENTS

| | | | |
|---|---|---|---|
| EP | 1 393 857 | A1 | 3/2004 |
| EP | 1393857 | A1 | 3/2004 |
| EP | 1396309 | A1 | 3/2004 |
| JP | S50-21035 | B1 | 7/1975 |
| JP | S51-40316 | B1 | 11/1976 |
| JP | 2004-092650 | A | 3/2004 |
| JP | 2004-516159 | A | 6/2004 |
| JP | 2007-516096 | A | 6/2007 |
| JP | 2012-081569 | A | 4/2012 |
| RU | 2 047 467 | C1 | 11/1995 |
| WO | 2000/032354 | A2 | 6/2000 |
| WO | 200032354 | A2 | 6/2000 |
| WO | 200032355 | A2 | 6/2000 |
| WO | 2004108356 | A1 | 12/2004 |
| WO | 2012052873 | A2 | 4/2012 |

OTHER PUBLICATIONS

Office Action and Search issued in connection with corresponding RU Application No. 2016110542 dated Jun. 29, 2018.

Italian Search Report and Written Opinion issued in connection with corresponding IT Application No. FI2013A000248 dated Jun. 5, 2014.

International Search Report and Written Opinion issued in connection with corresponding PCT Application No. PCT/EP2014/071939 dated Nov. 12, 2014.

Office Action issued in connection with corresponding RU Application No. 2016110542 dated Nov. 29, 2018.

* cited by examiner

Fig.1B
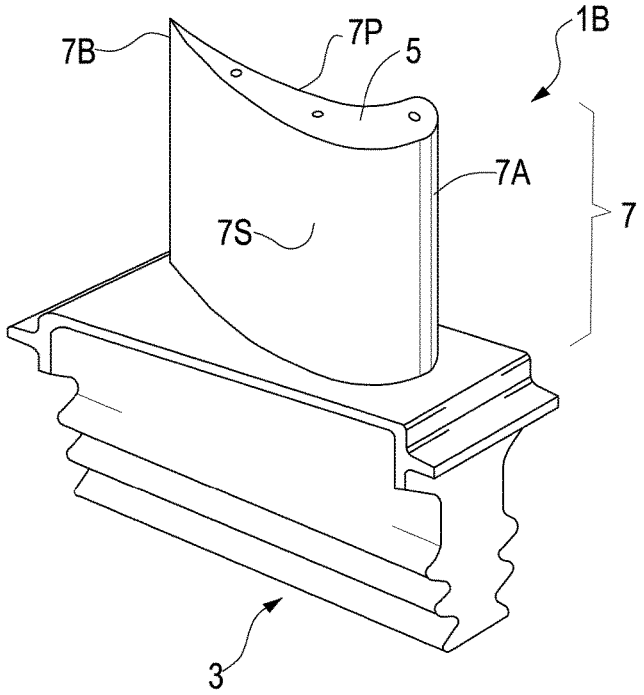
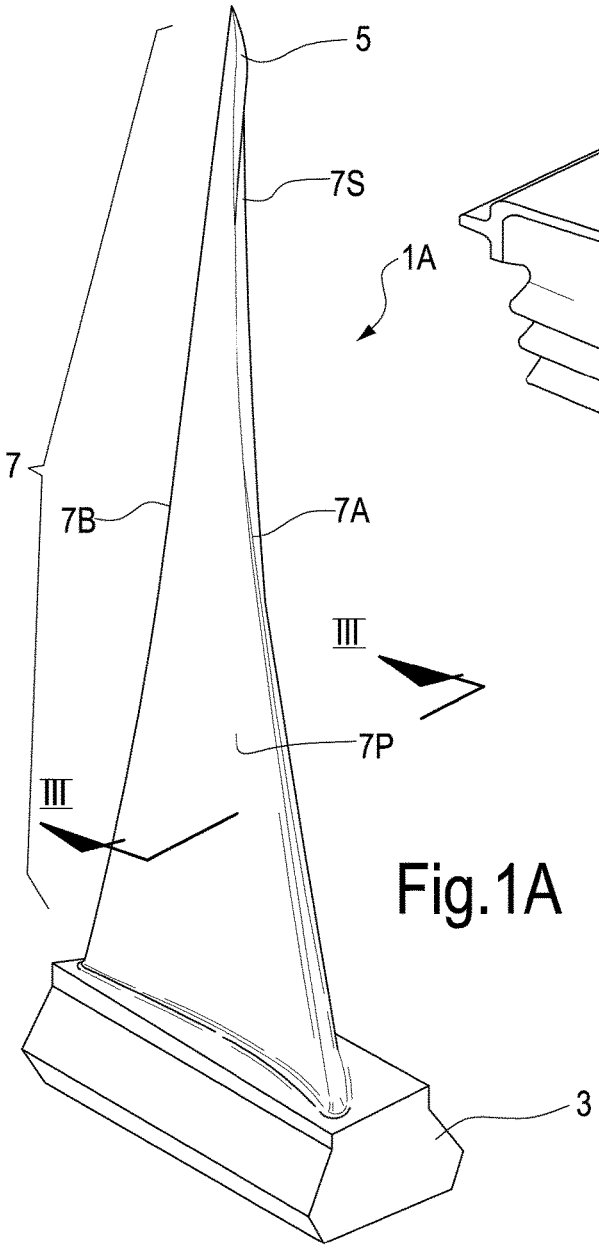
Fig.1A

Post Peen

Superfinished

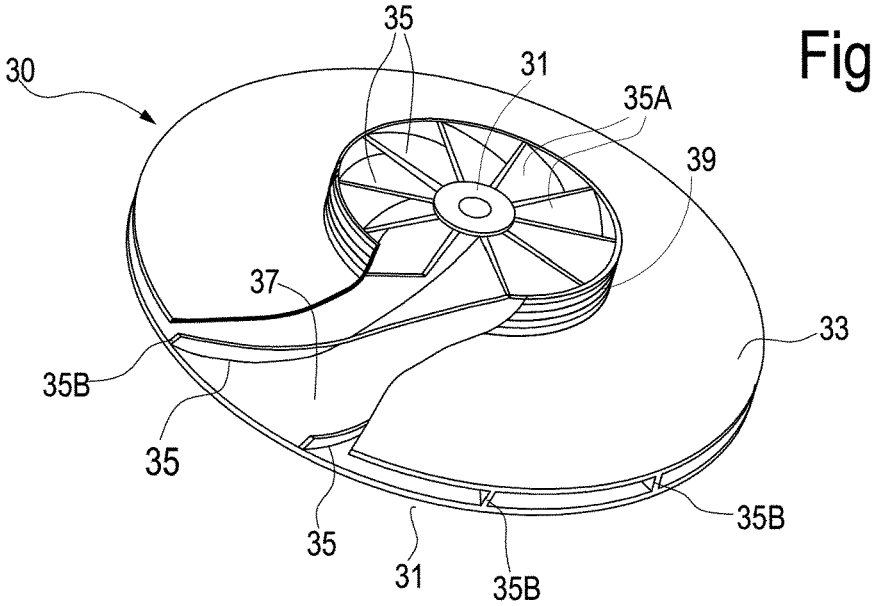
Fig.24
Fig.25
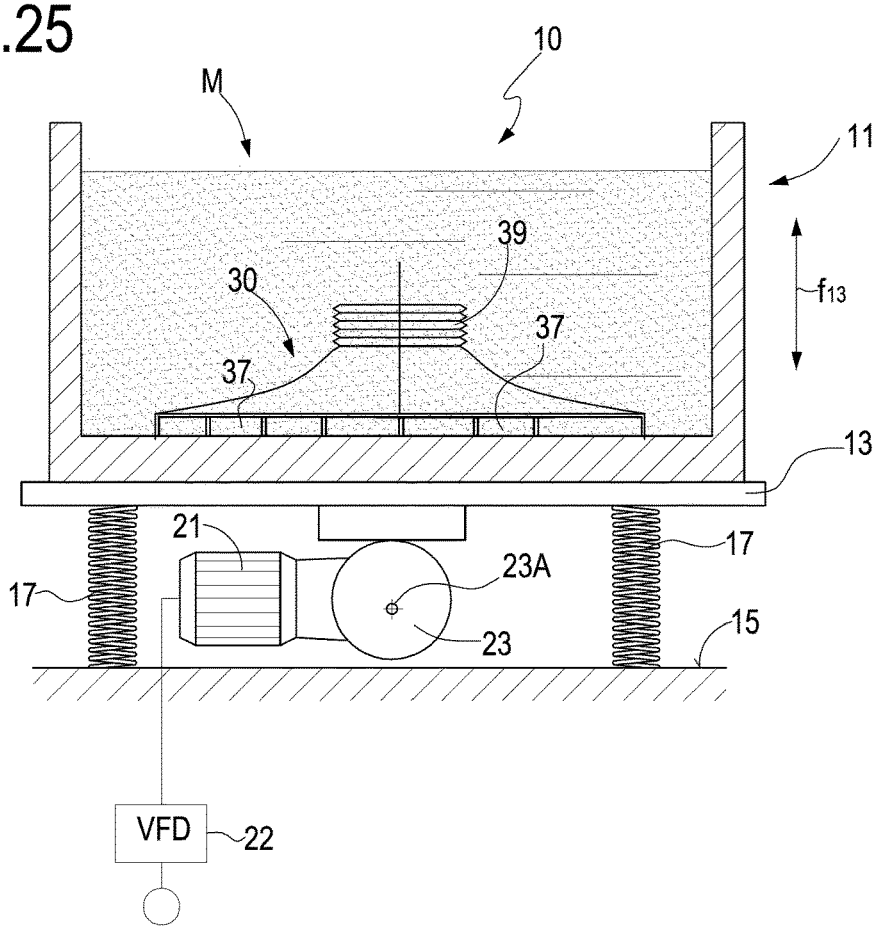

AIRFOIL MACHINE COMPONENTS POLISHING METHOD

BACKGROUND

The subject matter disclosed herein relates to manufacturing of machine components comprising airfoil portions such as, but not limited to, rotor and stator blades or buckets for axial turbomachines, impellers for radial or axial-radial turbomachines and the like.

Axial turbomachines, such as axial compressors and turbines, comprise one or more stages, each stage being comprised of a circular arrangement of stationary blades or buckets and circular arrangement of rotor blades or buckets. The blades are provided with a root and a tip. An airfoil portion extends between the root and the tip of each blade.

In order to improve the turbomachine efficiency, the blades are usually subject to a polishing step. Additional treatments can be performed on the blades prior to polishing. For example a shot peening step is usually performed prior to polishing or finishing, for increasing the blade strength. Shot peening increases the surface roughness. The polishing step is currently performed by vibratory finishing, e.g. by vibro-tumbling. Vibro-tumbling provides for the blades to be placed in a rotating tumbler filled with pellets made of a natural abrasive or synthetic abrasive and a ceramic binder. The tumbler is caused to rotate and/or vibrate so that the pellets polish the surface of the airfoil profile. The final arithmetic average roughness (Ra) which can be achieved by vibro-tumbling ranges around 0.63 μm.

Lower roughness values could be achieved by continuing the vibro-tumbling treatment of the blades. However, the effect of the pellets on the airfoil profile not only modifies the surface roughness and texture, but also the airfoil geometry. Lowering the roughness below the abovementioned values would result in inadmissible alterations of the geometry. For this reason, lower roughness values cannot be obtained with the polishing methods of the current art Shrouded impellers, e.g. for centrifugal compressors and pumps, are currently polished by means of so called abrasive flow machining. The abrasive flow machining process consists of generating a flow of a liquid suspension of abrasive material under pressure through the vanes of the impeller. Roughness values around 0.68 μm are achieved. Abrasive flow machining adversely affects the geometry of the blades, due to the abrasive action of the abrasive particles contained in the liquid suspension which is caused to flow under pressure through the vanes of the impeller. Moreover, the interaction between the blades and the abrasive flow is such that a non-homogeneous abrasive effect is obtained on the pressure side and suction side of each blade, due to the geometry of the latter. It is therefore not suitable to continue the abrasive flow machining process of an impeller beyond the above mentioned roughness values, since this would result in an unacceptable alteration of the blade geometry and therefore deterioration of the impeller efficiency.

The efficiency of a mechanical component comprised of an airfoil portion, such as an impeller or a blade, increases with reduced roughness, since energy losses due to friction are reduced. There is, therefore, a need for improving the finishing processes and methods in order to increase the efficiency of the airfoil profile by reducing the roughness thereof, without altering the geometry of the airfoil profile beyond an admissible threshold or tolerance.

SUMMARY OF THE INVENTION

An improved method is provided for polishing a machine component comprising at least one airfoil portion, comprised of a suction side, a pressure side, a leading edge and a trailing edge, which allows achieving particularly low roughness values on the airfoil surface.

In the present disclosure, including the annexed claims, unless differently specified, the surface texture and roughness are characterized by the arithmetic average roughness value (Ra). The arithmetic average roughness (Ra), also indicated as AA (arithmetic average) or CLA (Center Line Average) is the arithmetic averaged deviation of the actual surface from the mean line or center line within an assessment length (L) and is defined as $$Ra = \frac{1}{L}\int_{x=0}^{x=L} |y|\, dx$$

or:

$$R_a = \frac{1}{n}\sum_{i=1}^{n} |y_i|$$

Unless differently specified, the arithmetic average roughness (Ra) used herein is expressed in micrometers (μm). Unless differently specified, in the description and in the claims the term roughness shall be understood as being the arithmetic average roughness as defined above.

According to some embodiments, the method comprises:

arranging the machine component in a container and constraining the machine component to the container;

adding a polishing mixture in the container, the polishing mixture containing at least: abrasive powder, a liquid and metal particles;

vibrating the container and the machine component constrained thereto, thereby generating a polishing mixture flow along the airfoil portion until a final arithmetic average roughness is achieved.

In some embodiments, polishing is continued until a final arithmetic average roughness equal to or less than 0.3 μm is achieved on the machine component. It has been surprisingly discovered that the method disclosed herein can achieve such very low roughness values in a relatively short time and maintaining the geometry, i.e. the dimension and shape of the airfoil profile substantially unaltered, i.e. the roughness values mentioned above are achieved without adversely affecting the overall geometry of critical components such as turbine blades or buckets, turbomachine impellers and the like. Polishing methods according to the current art cannot be used to reach such low arithmetic average roughness values without causing unpredictable alterations of the airfoil profile, which would make the polished machine component actually unusable.

According to some embodiments, the treatment is applied until a final arithmetic average roughness equal to or less than 0.20 μm, may be equal to or less than 0.17 μm and more particularly equal to or less than 0.15 μm is obtained on the airfoil profile.

The container can be connected to a vibrating arrangement, for instance comprising a rotating cam and an electric motor. Arrangements can be provided for tuning the vibration frequency. According to some embodiments the method can thus further include a step of selecting a vibration frequency of the container and the machine component constrained thereto, which cause the metal particles advancing along the airfoil portion in adhesion thereto and generating a polishing action of the airfoil portion by means of abrasive powder between the airfoil portion and metal particles sliding there along. One or more vibration frequency values can be determined, depending e.g. upon the structural features and shapes of the machine components, which determine such a sliding advancement of the metal particles along the airfoil portion. Selection of the vibration frequency can be obtained experimentally, e.g. by gradually varying the rotation speed of an electric motor driving a cam which co-acts with the container. Suitable vibration frequencies can be selected by observing the movement of the metal particles or chips on the surface of the machine component.

In some embodiments, metal particles can be used having substantially planar surfaces. The metal particles can be caused to advance by vibration along the airfoil portion with the planar surfaces thereof in contact with the airfoil portion.

The machine components can be subjected to preliminary treatment processes, such as e.g. to a preliminary shot peening treatment.

According to some embodiments, the step of generating a flow of the polishing mixture along the airfoil portion comprises advancing the metal particles of the polishing mixture along the pressure side and the suction of the airfoil portion.

The machine component can be e.g. a blade or bucket of an axial turbomachine, having a root and a tip. The airfoil portion extends between the root and the tip, an airfoil chord being defined between the trailing edge and the leading edge in each position of the airfoil portion from the root to the tip.

In some embodiments of the method disclosed herein, the length of the chord is maintained substantially unaltered during the step of vibrating the machine component until a final arithmetic average roughness of 0.3 μm or less, may be 0.2 μm or less, more particularly of 0.17 μm or less is achieved. The chord length can be subjected to a variation which is less than an admissible tolerance value. For instance, the variation of the chord length can be equal to or less than 0.05% and more particularly equal to or less than 0.03%.

According to some embodiments, the variation of the chord length from the beginning to the end of the step of vibrating the container and the machine component constrained thereto can be equal to or less than 0.1 mm, may be equal to or less than 0.07 mm and even more particularly equal to or less than 0.02 mm.

A chord length variation during polishing, which remains equal to or below 0.1 mm and more particularly equal to or below 0.07 mm, results in the blade geometry and thus the blade functionality remaining substantially unaltered. Thus, according to some embodiments, when the machine component is a blade or a bucket of an axial turbomachine, the feature of maintaining the dimension and shape of the airfoil portion substantially unaltered means that the alteration of the chord length is equal to or less than 0.1 mm and more particularly equal to or less than 0.07 mm, e.g. equal to or less than 0.02 mm.

According to some embodiments, the machine component is a turbomachine impeller comprised of a hub with a central drive-shaft receiving bore and a plurality of blades arranged on the hub around the drive-shaft receiving bore. The blades form airfoil portions, each blade having a suction side and a pressure side. Vanes are defined between adjacent blades. Each vane has an inlet and an outlet and each blade has a leading edge at the inlet and a trailing edge at the outlet of the corresponding vane. By vibrating the machine component a polishing mixture flow is created, which circulates in and through the vanes of the impeller.

During the step of vibrating the machine component, the thickness of the blades of the impeller is reduced by less than 0.5% on average and may be by less than 0.4% on average, while a final arithmetic average roughness of the inner surface of the vanes is achieved, which can be equal to or less than 0.3 μm and more particularly equal to or less than 0.2 μm.

According to some embodiments, the variation of the blade thickness from the beginning to the end of the step of vibrating the container and the machine component constrained thereto can be equal to or less than 0.1 mm, may be equal to or less than 0.07 mm and even more particularly equal to or less than 0.02 mm.

A blade thickness variation during polishing, which remains equal to or less than 0.1 mm and more particularly equal to or less than 0.07 mm, results in the blade geometry and thus the blade functionality remaining substantially unaltered. Thus, according to some embodiments, when the machine component is an impeller for a turbomachine, e.g. an impeller for a radial pump or compressor, the feature of maintaining the dimension and shape of the airfoil portion substantially unaltered means that the alteration of the thickness of the impeller blades is equal to or less than 0.1 mm and may be equal to or less than 0.07 mm, e.g. equal to or less than 0.02 mm.

According to some embodiments, the impeller comprises a shroud comprised of an impeller eye. The shroud, the hub and adjacent impeller blades define flow vanes there between, each flow vane having an outlet aperture at the trailing edges of the blades. In some embodiments, the method provides for vibrating the impeller and generating a polishing mixture flow through the vanes, which causes the axial dimension of the outlet apertures to vary on average less than 0.05% and more particularly less than 0.04% with respect to the initial axial dimension.

In some embodiments the metal particles comprise metal chips. In particularly some embodiments, the metal particles comprise copper particles or copper chips.

In some embodiments the abrasive powder is aluminum oxide, ceramic or a combination thereof. The liquid can comprise or can be water. Additionally, a polishing medium can be added.

According to some embodiments the polishing mixture has the following composition by weight:

metal particles 90-98%
abrasive powder 0.05-0.4%
liquid 3-10%.

The step of vibrating the container and the machine component constrained thereto can last between 5 and 8 hours, more particularly between 6 and 7 hours.

According to other embodiments, the step of vibrating the container and the machine component constrained thereto can last between 1.5 and 10 hours.

In some embodiments, e.g. when axial turbomachine blades or buckets are polished, the vibrating step can last between 1 and 3 hours, e.g. between 1 and 2 hours.

According to a different aspect, the present disclosure also relates to a machine component comprising an airfoil portion, wherein the airfoil portion has an arithmetic average roughness equal to or less than 0.3 μm, may be equal to or less than 0.2 μm, more particularly equal to or less than 0.17 μm and even more particularly equal to or less than 0.15 μm. The machine component can be selected from the group comprising: an axial turbomachine blade or bucket; a turbomachine impeller.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein:

FIGS. 1A and 1B illustrate machine components comprising an airfoil portion, which can be polished with the method disclosed herein;

FIG. 24 illustrates an exemplary embodiment of a compressor impeller;

FIG. 25 illustrates polishing of a compressor impeller according to the method disclosed herein;

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Polishing of Blades of Axial Turbomachines

FIG. 1A illustrates a perspective view of an exemplary embodiment of a compressor blade for an axial turbocompressor, labeled 1A as a whole. The compressor blade 1A comprises a root 3 and a tip 5. An airfoil portion 7 extends between the root 3 and the tip 5. The airfoil portion is comprised of a leading edge 7A and a trailing edge 7B. The airfoil portion further comprises a pressure side 7P and a suction side 7S.

FIG. 1B illustrates a perspective view of an exemplary embodiment of a gas turbine blade, designated 1B as a whole. The turbine blade 1A comprises a root 3 and a tip 5. An airfoil portion 7 extends between the root 3 and the tip 5. The airfoil portion 7 has a suction side 7S and a pressure side 7P, a leading edge 7A end a trailing edge 7B.

The axial compressor blade 1A shown in FIG. 1A and the turbine blade 1B shown in FIG. 1B are provided as exemplary embodiments of possible machine components, which can be suitably polished with the method disclosed herein. Those skilled in the art of turbomachinery will understand that other kinds of machine components comprised of at least one airfoil portion can be treated with the method disclosed herein, for example stationary axial compressor blades, stationary turbine blades or buckets, as well as impellers for centrifugal turbomachines, such as turbocompressors and pumps, as will be disclosed in more detail later on.

Figure 2:
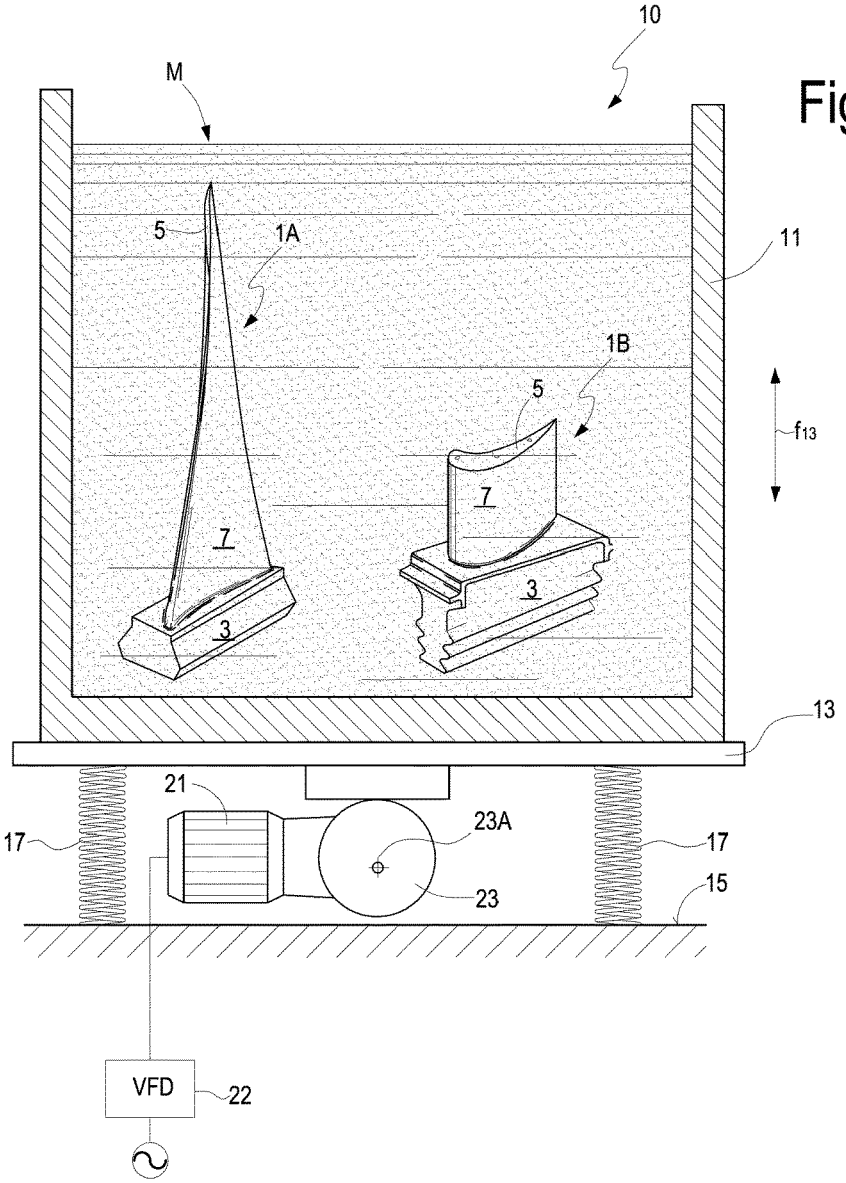
FIG. 2 schematically illustrates polishing of turbomachine blades according to the method disclosed herein.

The machine component 1A, 1B can be subjected to a surface-treatment step, for example a shot peening treatment. Once the machine component 1A, 1B has been pre-polished, it can be treated in a polishing machine. A schematic representation of an exemplary embodiment of a polishing machine 10 is shown in FIG. 2. The polishing machine 10 comprises a container 11, wherein the machine components are placed. The machine components are directly or indirectly constrained to the container 11, so as to move therewith. In some embodiments the container 11 can be constrained to a vibrating table 13. The vibrating table 13 can be connected to a stationary base 15, for example through one or more resilient members 17. The resilient members 17 can be comprised of a helical springs or the like. In some embodiments a viscoelastic arrangement can be used instead of a simple resilient member arrangement 17.

In order to control the vibration of the vibrating table 13, in some embodiments one or more electric motors 21 are provided. The motor 21 controls rotation of an eccentric cam 23, which can rotate around a substantially horizontal axis 23A. The rotation of the eccentric cam 23 causes the vibrating table 13 and the container 11 constrained thereto to vibrate in a vertical direction, as schematically shown by a double-arrow f13.

In the container 11 one or more machine components 1A, 1B comprised of an airfoil portion can be arranged. In an embodiment, each machine component 1A, 1B is constrained to the container 11, so that the machine components 1A, 1B vibrate integrally with the container 11 and the vibrating table 13.

The container 11 is partly or entirely filled with an polishing mixture M. The polishing mixture can entirely cover the machine components 1A, 1B, so that the machine components are entirely submerged by the polishing mixture M. In other embodiments of the method disclosed herein a smaller amount of polishing mixture M can be used, only partially covering the machine components 1A, 1B, for example till 60%, 70% or 80% of the entire height H of the machine components 1A, 1B.

The polishing mixture M can be comprised of a liquid, for example water, metal particles and an abrasive powder. The metal particles can comprise metal chips, for example copper particles, such as copper chips. The abrasive powder can be selected from the group consisting of: aluminum oxide, ceramic particles, or combination thereof.

The metal particles can have a substantially planar shape, i.e. can be made of fragments of metal foils or laminae. In some embodiments the metal particles can have a thickness of between 1 and 2 mm. In some embodiments, the metal particles can have a cross-dimensions of between 3 and 5 mm.

The abrasive particles may have a grain side between 2 and 8 μm.

The polishing mixture M can further comprise a polishing medium. The polishing medium can be selected from the group consisting of: soap, passivizing liquid, or a mixture thereof.

The composition by weight of the polishing mixture M can comprise the following:

metal particles: 90-98% wt abrasive powder: 0.05-0.4% wt liquid: 3-10% wt.

Once the polishing mixture has been introduced in the container 11, the latter is put into vibration by starting the motor 21. The vibration frequency can be suitably tuned, e.g. using a variable frequency driver 22. In an embodiment, treatment is performed at a vibration frequency which is set so that the metal particles of the polishing mixture advance slidingly along the surface of the airfoil portion 7 in contact therewith. The vibration frequency which causes this phenomenon can easily be selected for example by starting from a low frequency value and stepwise or continuously increasing the vibration frequency until the sliding movement of the metal particles is triggered, a condition which can be easily detected by the operator. Using a suitable variable frequency driver 22 for the electric motor 21 the vibration frequency can be tuned to the effective value which initiates the sliding advancement movement of the metal particles along the airfoil portion 7.

Figure 3:
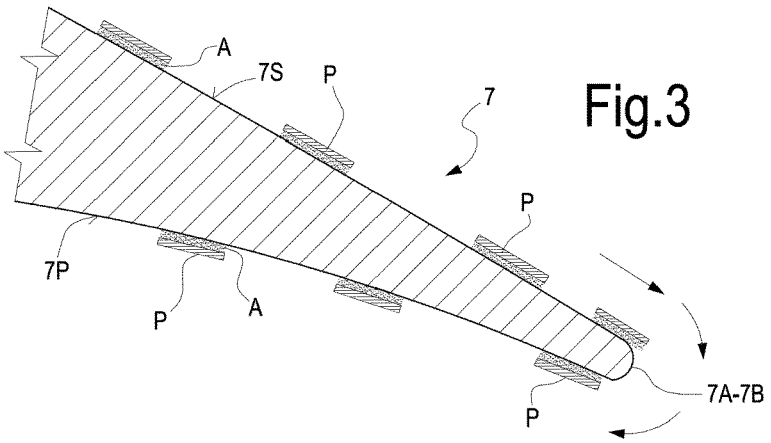
FIG. 3 schematically illustrates the action of the polishing media on the airfoil portion.

FIG. 3 schematically shows the phenomenon described above that is triggered by the selected vibration frequency: metal particles schematically shown at P adhere to the surface 7S and 7P of the airfoil portion 7 and advance as shown by the dashed arrows under the effect of the vibration of the machine component 1A, 1B constrained to the vibrating container 11 and to the vibrating table 13. Abrasive particles A are trapped between the metal particles P and the surface 7S or 7P of the airfoil portion 7. The abrasive particles A adhere to the metal particles and are advanced therewith under the effect of the vibration generated by the motor 21. The advancement of the metal particles P with the abrasive powder A trapped between the latter and the surfaces 7S and 7P airfoil portion provokes a polishing effect on the surface under treatment.

Since the advancing movement is determined by the vibration of the machine components 1A, 1B in the container 11, there is substantially no pressure applied against the surface of the airfoil portion 7 and the abrasive effect is extremely gentle.

As schematically shown in FIG. 3, when the metal particles or chips P reach the trailing edge or the leading edge 7A, 7B of the airfoil portion 7, they substantially loose contact with the machine component and either move away from the machine component or rotate around the edge moving from the pressure side to the suction side or vice-versa. Tilting of the metal particles P around the edges 7A, 7B takes place with substantially no pressure being exerted between the airfoil portion 7 and the metal particles P, so that the shape of the edges 7A, 7B is preserved and no geometric alteration thereof is caused by the metal particle flow around the edges.

Tests performed on several airfoil profiles of machine components show that the effect of this polishing method results in unexpectedly low roughness values, without adversely affecting the geometry of the airfoil profile.

Example 1: Polishing of Stationary and Rotary Blades of an Axial Turbine

The results of tests performed on a plurality of samples of stationary and rotary blades or buckets for axial turbines will be discussed here below, to show the effectiveness of the polishing method in terms of roughness achieved and conservation of the geometry of the profile.

The tests were performed on samples of buckets or blades of a heavy duty gas turbine available from General Electric, Evendale, Ohio, USA.

Tests were performed on rotor blade samples from the 2nd, 3rd, and 11th turbine stage and on stationary blades of the 5th, 6th, and 8th stage.

Among the several parameters describing the geometry of the blades and which can be used to check the effect of the polishing process over the overall geometry of the airfoil profile of the blades, the chord variation has been chosen. The chord has been measured at different distances from the blade root before and after the polishing process, to check how the polishing process affects this parameter.

As mentioned above, current art finishing processes negatively affect in particular the dimension of the blade chord due to the impact of the abrading pellets on the leading and the trailing edges of the blades, which lead to erosion of the edges, modification of their radius of curvature and alteration of the chord dimension. The chord dimension is therefore a critical parameter to be checked after polishing, to establish whether the polishing process has modified the geometry of the blade to such an extent that it can prejudice the blade efficiency.

The following Table n. 1 summarizes the main data of the blades tested. The table indicates the number of the rotor or stator of the gas turbine to which the tested blades or buckets belong, the number of the samples tested and the polishing cycle time. Aluminum oxide was used as abrasive and copper particles were used in the polishing mixture. The composition of the polishing mixture was as follows:

metal particles: 95% wt abrasive powder: 0.10% wt water: 4.9% wt.

TABLE 1

| Stage | Sample n. Tested | Cycle Time [min] |
|---|---|---|
| Rotor 2 | 19 | 120 |
| | 12 | 170 |
| | 10 | 170 |
| | 26 | 220 |
| Rotor 3 | 11 | 120 |
| | 19 | 120 |
| | 23 | 120 |
| | 24 | 120 |
| | 7 | 170 |
| | 38 | 220 |
| Rotor 11 | 1 | 120 |
| | 35 | 120 |
| | 7 | 170 |
| | 19 | 170 |
| | 26 | 220 |
| | 29 | 220 |
| Stator 5 | 6 | 120 |
| | 50 | 120 |
| | 52 | 170 |
| | 70 | 170 |
| | 9 | 220 |
| | 81 | 220 |
| Stator 8 | 26 | 120 |
| | 41 | 120 |
| | 52 | 170 |
| | 58 | 170 |
| | 6 | 220 |
| | 39 | 220 |
| Stator 16 | 26 | 120 |
| | 27 | 120 |
| | 85 | 170 |
| | 98 | 170 |
| | 114 | 220 |
| | 119 | 220 |

Figure 4:
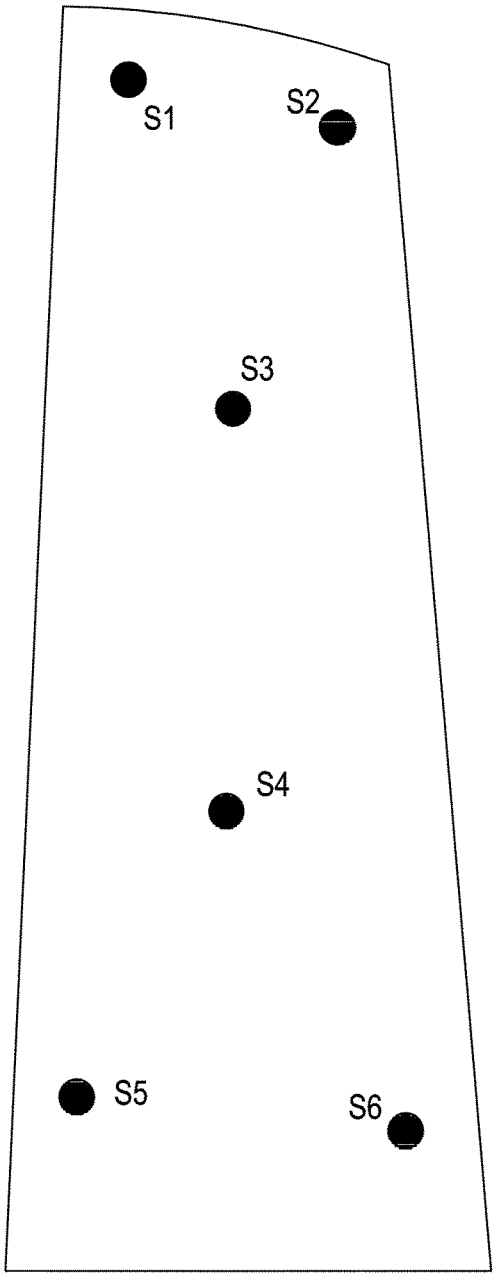
FIGS. 4 and 5 illustrate exemplary airfoil portions and the position where roughness measurements are made.

Referring first to the second rotor stage, the following Table n. 2 reports the arithmetic average roughness Ra measured on four different samples numbered 19, 12, 10, 26 in six different points of the suction side surface of each sample blade after shot-peening and before polishing. The samples are numbered with sample number (S/N) 19, 12, 10, 26. As mentioned above, the measurements are expressed in μm (micrometers). The position of the six points where the arithmetic average roughness Ra has been measured is shown in FIG. 4. The local arithmetic average roughness value in each point S1-S6 is reported columns S1 to S6. The last column indicates the average calculated on each sample (average of six Ra values measured in points S1-S6 for each sample):

TABLE 2

| S/N | S1 | S2 | S3 | S4 | S5 | S6 | Avg |
|---|---|---|---|---|---|---|---|
| 19 | 1.110 | 1.220 | 1.180 | 1.150 | 1.150 | 1.240 | 1.175 |
| 12 | 1.250 | 1.430 | 1.110 | 1.210 | 1.080 | 1.140 | 1.203 |
| 10 | 1.160 | 1.270 | 1.160 | 1.100 | 1.140 | 1.380 | 1.202 |
| 26 | 1.180 | 1.120 | 1.230 | 1.190 | 1.160 | 1.090 | 1.162 |

Table 3 shows the arithmetic average roughness Ra measurements on the same rotor blade samples on the pressure side thereof in four different locations labeled P1 to P4, the position whereof is shown schematically in FIG. 4. Table 3 reports the sample number (S/N) in the first column and the arithmetic average roughness value for each sample and each one of the four points P1-P4 in columns P1, P2, P3 and P4. The last column (Avg) shows the average of the four roughness values Ra measured on each sample (average of four measurements on points P1-P4). The values are again measured after shot peening and before polishing:

TABLE 3

| S/N | P1 | P2 | P3 | P4 | Avg |
|---|---|---|---|---|---|
| 19 | 1.310 | 1.280 | 1.330 | 1.220 | 1.285 |
| 12 | 1.270 | 1.570 | 1.120 | 1.080 | 1.260 |
| 10 | 1.440 | 1.440 | 1.310 | 1.290 | 1.370 |
| 26 | 1.290 | 1.240 | 1.400 | 1.380 | 1.328 |

The following Tables 4 and 5 report the roughness values Ra on the same samples and the same measurement points as well as the average value (last column, Avg) after a polishing process as described above:

TABLE 4

| S/N | S1 | S2 | S3 | S4 | S5 | S6 | Avg |
|---|---|---|---|---|---|---|---|
| 19 | 0.190 | 0.210 | 0.180 | 0.160 | 0.150 | 0.120 | 0.168 |
| 12 | 0.200 | 0.180 | 0.160 | 0.160 | 0.180 | 0.100 | 0.163 |
| 10 | 0.150 | 0.190 | 0.170 | 0.190 | 0.130 | 0.100 | 0.155 |
| 26 | 0.150 | 0.170 | 0.120 | 0.140 | 0.110 | 0.110 | 0.133 |

TABLE 5

| S/N | P1 | P2 | P3 | P4 | Avg |
|---|---|---|---|---|---|
| 19 | 0.260 | 0.180 | 0.180 | 0.140 | 0.190 |
| 12 | 0.100 | 0.090 | 0.120 | 0.100 | 0.103 |
| 10 | 0.110 | 0.130 | 0.100 | 0.150 | 0.123 |
| 26 | 0.070 | 0.100 | 0.100 | 0.150 | 0.105 |

Figure 6:
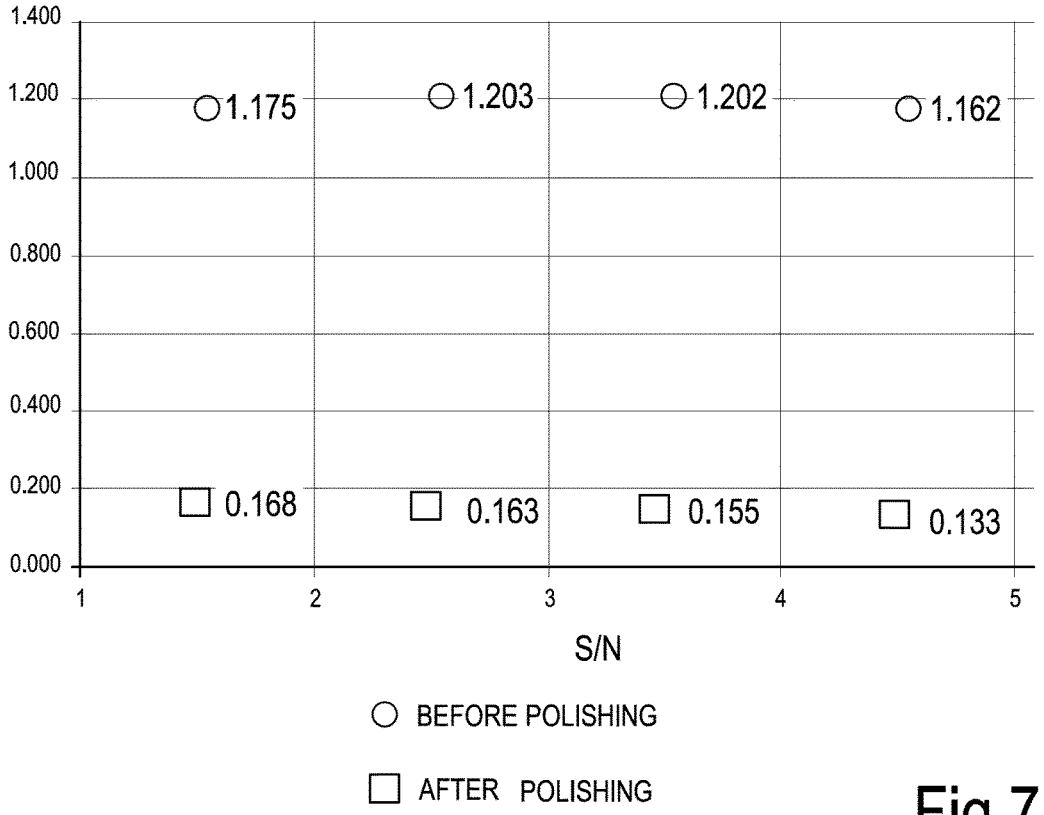
FIGS. 6, 7, 8, 9, 10, 11, 12, 13, 14, 15, 16, 17, 18, 19, 20, 21, 22, and 23 illustrate diagrams reporting measurements made on turbine blade samples polished with a method as described herein.
Figure 7:
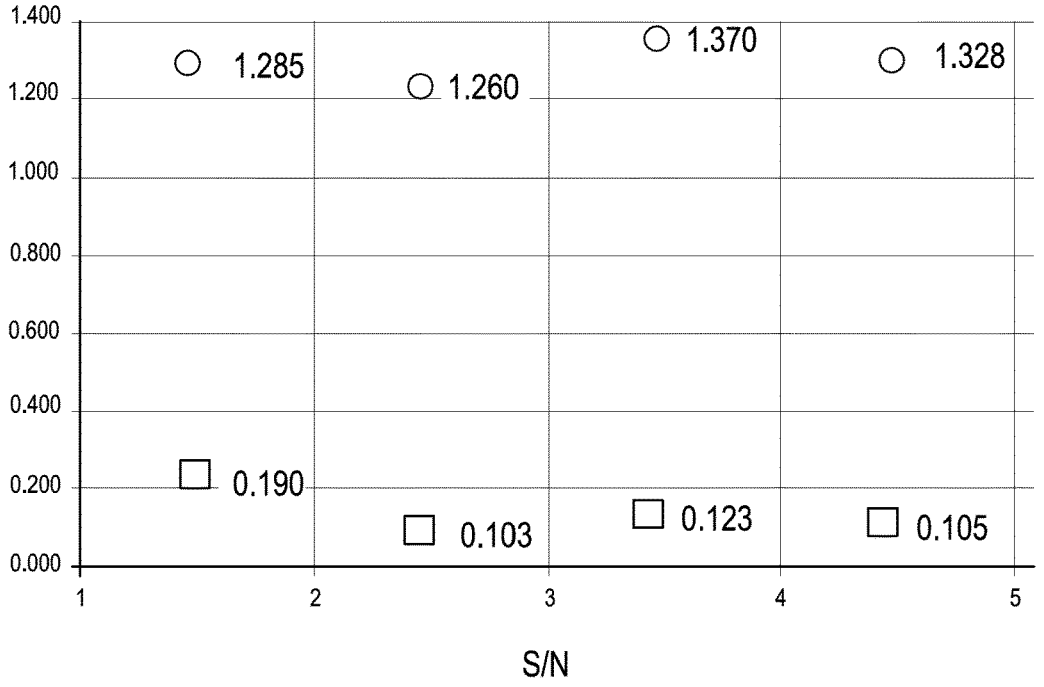

FIGS. 6 and 7 show the above reported roughness data in two diagrams. FIG. 6 reports the average value (Avg) of the arithmetic average roughness Ra measured on the six points S1-S6 on the suction side, before and after polishing respectively, for the four samples tested. The sample number (SN) is reported on the abscissa and corresponds to the sample number in the left-hand column of Tables 2-5. FIG. 7 reports the same arithmetic average roughness before and after polishing for the same four samples on the pressure side.

The above reported data summarized in the diagrams of FIGS. 6 and 7 show that the polishing performed on the samples under test achieve an arithmetic average roughness far below what can be achieved by vibro-tumbling. On both the suction and pressure sides of all the samples tested an arithmetic average roughness lower than 0.2 μm and in some cases around 0.1 μm has been achieved.

The tests also show that the arithmetic average roughness improves very little after 120 minutes treatment time. The treatment time for each sample is shown in Table 1.

Figure 8:
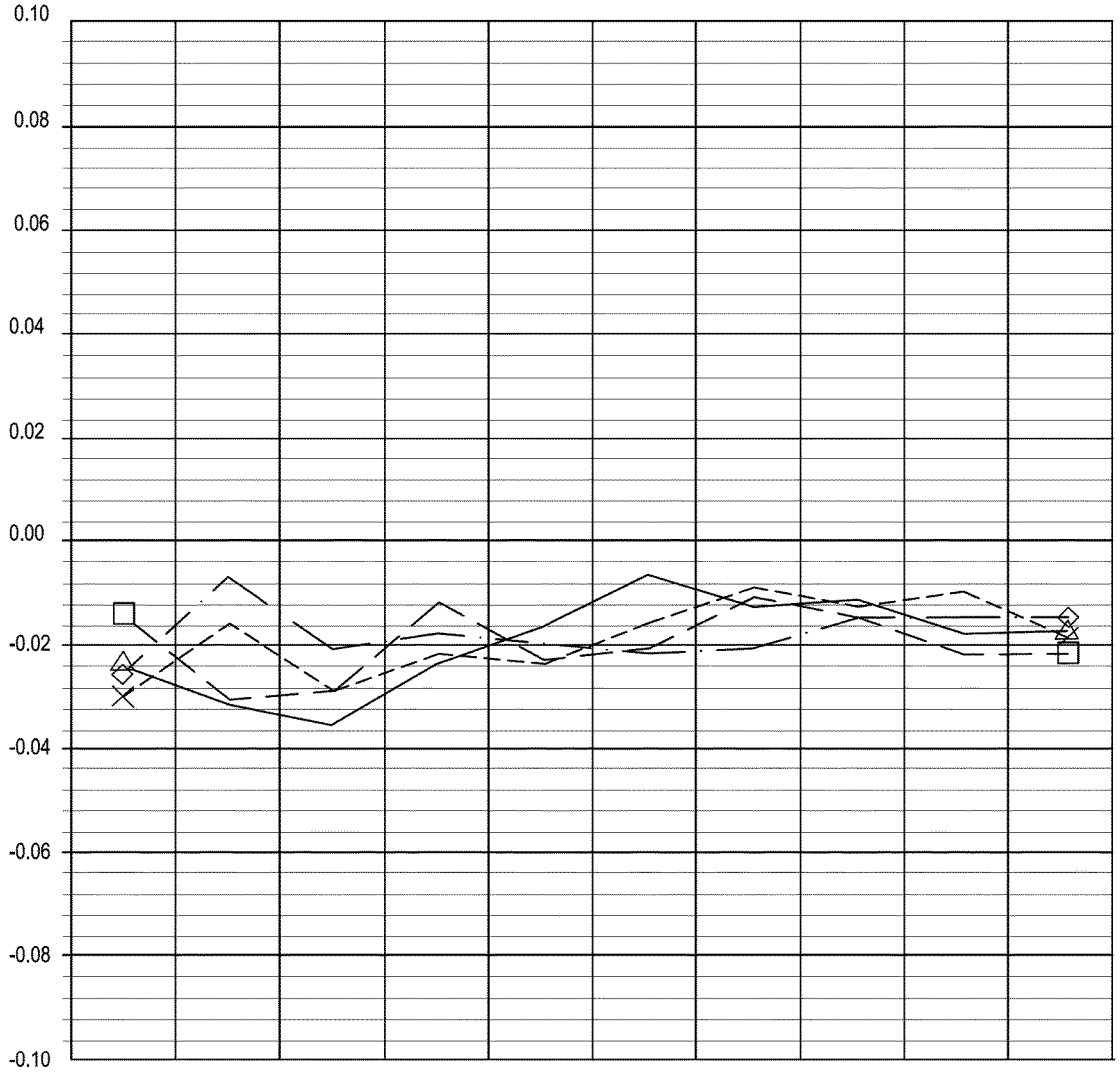

In order to check whether the final blade geometry obtained after polishing is consistent with the strict requirements applied to this kind of machine components, the extension of the chord profile has been measured before and after the polishing treatment on all four samples under test. FIG. 8 reports the difference of the measured chord dimensions before and after polishing. Measurements were carried out at ten different positions of the blade, starting from the root toward the tip and are reported along the horizontal axis. The dimensional difference is reported on the vertical axis and is expressed in mm. The same parameters are shown in the following FIGS. 11, 14, 17, 20, 23, which refer to tests performed on further blades and buckets samples and which will be discussed later on.

The data reported in FIG. 8 show that in each case the discrepancy between the initial geometry and the final geometry of the blades after polishing is negligible. This shows that, in spite of the very efficient polishing achieved, with roughness values (Ra) below 0.2 μm, the geometry of the blade remains substantially unchanged.

Tests performed on several turbomachine blades have shown that the total alteration of the chord dimension is less than 0.1 mm, usually equal to or less than 0.07 mm and that alterations as low as 0.02 mm can be achieved, while still obtaining the above mentioned desired arithmetic average roughness values on the pressure and suction sides of the blade.

The following Tables 6 to 9 report the roughness measurements on six rotor blade samples of the third turbine stage. FIGS. 6 and 7 report the arithmetic average roughness values (Ra) for the suction side and the pressure side, respectively, based on the data reported in tables 6 to 9, before and after the polishing process. Table 6 shows the local arithmetic average roughness (Ra) measured in micrometers on six points S1-S6 (located as shown in FIG. 4) on the suction side of each one of the six samples numbered 19, 11, 23, 24, 7 and 38 before polishing:

TABLE 6

| S/N | S1 | S2 | S3 | S4 | S5 | S6 | Avg |
|---|---|---|---|---|---|---|---|
| 19 | 1.260 | 1.210 | 1.440 | 1.380 | 1.170 | 1.260 | 1.287 |
| 11 | 1.250 | 1.280 | 1.310 | 1.520 | 1.380 | 1.490 | 1.372 |
| 23 | 1.290 | 1.360 | 1.230 | 1.460 | 1.230 | 1.180 | 1.292 |
| 24 | 1.340 | 1.380 | 1.420 | 1.450 | 1.370 | 1.310 | 1.378 |
| 7 | 1.230 | 1.340 | 1.290 | 1.310 | 1.400 | 1.420 | 1.332 |
| 38 | 1.290 | 1.350 | 1.270 | 1.320 | 1.420 | 1.400 | 1.342 |

Figure 5:
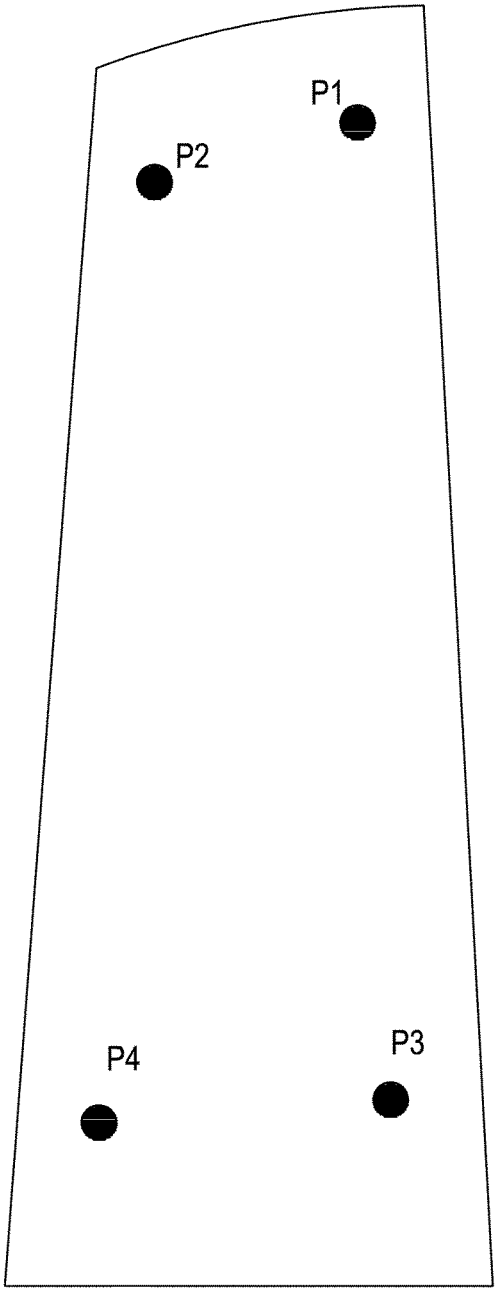

The following Table 7 shows the arithmetic average roughness values measured on four points P1-P4 on the pressure side (FIG. 5) of the same six blade samples before polishing:

TABLE 7

| S/N | P1 | P2 | P3 | P4 | Avg |
|---|---|---|---|---|---|
| 19 | 1.130 | 1.330 | 1.320 | 1.640 | 1.355 |
| 11 | 1.380 | 1.350 | 1.330 | 1.350 | 1.353 |
| 23 | 1.200 | 1.300 | 1.230 | 1.270 | 1.250 |
| 24 | 1.330 | 1.290 | 1.300 | 1.260 | 1.295 |
| 7 | 1.290 | 1.320 | 1.300 | 1.230 | 1.285 |
| 38 | 1.440 | 1.380 | 1.290 | 1.150 | 1.315 |

The following Tables 8 and 9 show the arithmetic average roughness values measured on the same samples and in the same points as in Tables 6 and 7 after polishing:

TABLE 8

| S/N | S1 | S2 | S3 | S4 | S5 | S6 | Avg |
|---|---|---|---|---|---|---|---|
| 19 | 0.140 | 0.190 | 0.180 | 0.140 | 0.130 | 0.280 | 0.177 |
| 11 | 0.110 | 0.110 | 0.100 | 0.140 | 0.120 | 0.110 | 0.115 |
| 23 | 0.110 | 0.170 | 0.150 | 0.180 | 0.170 | 0.180 | 0.160 |
| 24 | 0.130 | 0.140 | 0.110 | 0.100 | 0.100 | 0.110 | 0.115 |
| 7 | 0.120 | 0.110 | 0.110 | 0.250 | 0.110 | 0.100 | 0.133 |
| 38 | 0.100 | 0.090 | 0.130 | 0.170 | 0.100 | 0.100 | 0.115 |

TABLE 9

| S/N | P1 | P2 | P3 | P4 | Avg |
|---|---|---|---|---|---|
| 19 | 0.110 | 0.110 | 0.120 | 0.110 | 0.113 |
| 11 | 0.090 | 0.110 | 0.090 | 0.090 | 0.095 |
| 23 | 0.090 | 0.160 | 0.180 | 0.150 | 0.145 |

TABLE 9-continued

| S/N | P1 | P2 | P3 | P4 | Avg |
|---|---|---|---|---|---|
| 24 | 0.090 | 0.110 | 0.120 | 0.130 | 0.113 |
| 7 | 0.090 | 0.100 | 0.090 | 0.100 | 0.095 |
| 38 | 0.080 | 0.070 | 0.080 | 0.080 | 0.078 |

The sample number (S/N) is reported in the first column.

Figure 9:
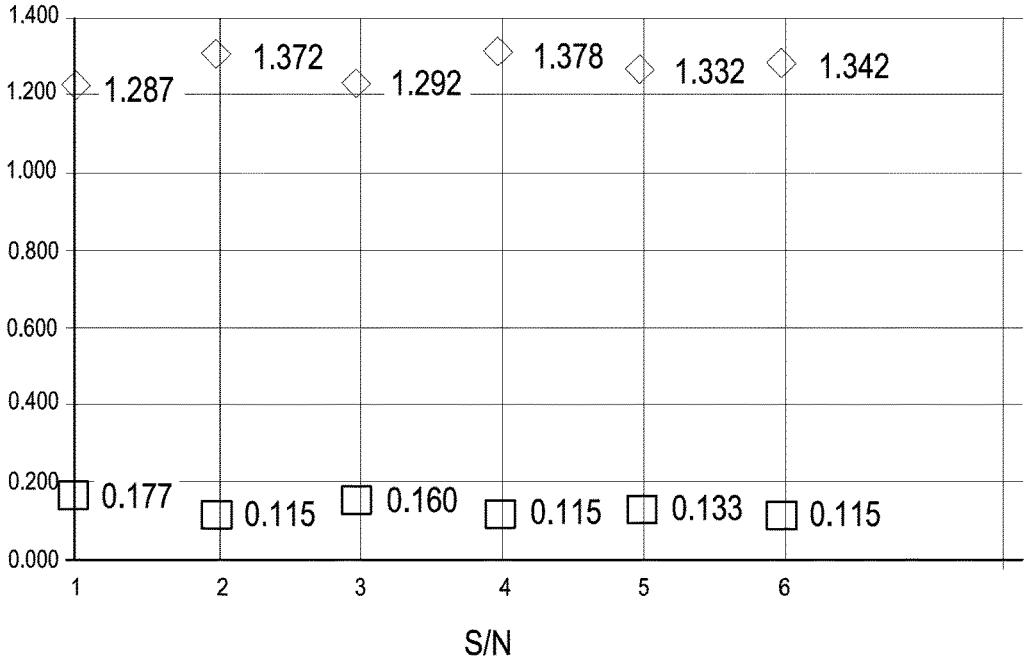
Figure 10:
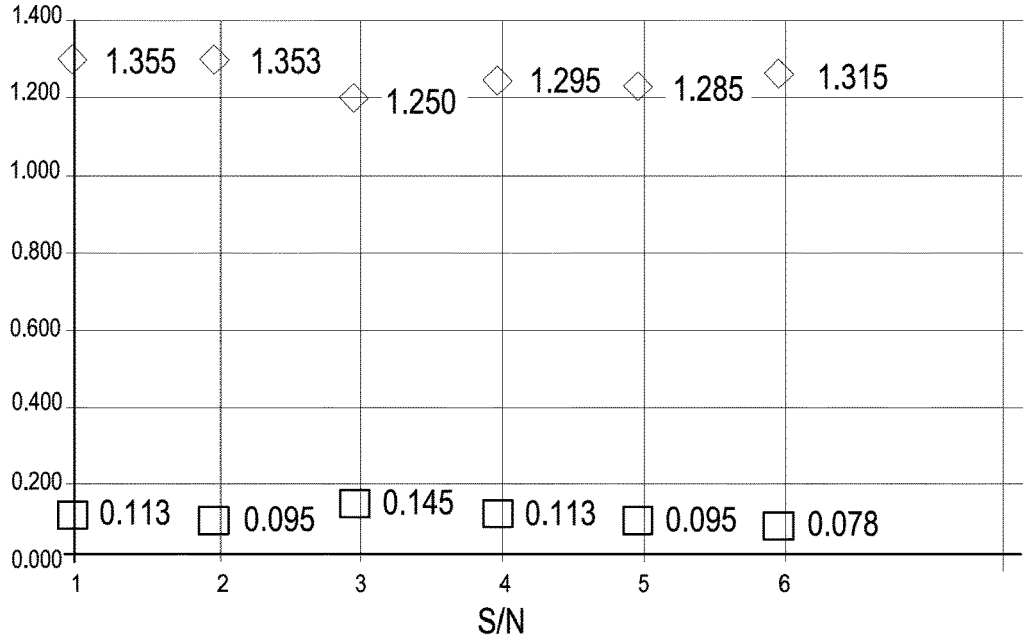

FIGS. 9 and 10 show two diagrams which report the arithmetic average roughness data prior and after polishing on the suction side (FIG. 9) and on the pressure side (FIG. 10). The sample number (S/N) is reported on the abscissa and corresponds to the sample number listed in the first column in Tables 6 to 9. The data reported in the diagrams are the average values shown in the last column of the tables.

Figure 11:
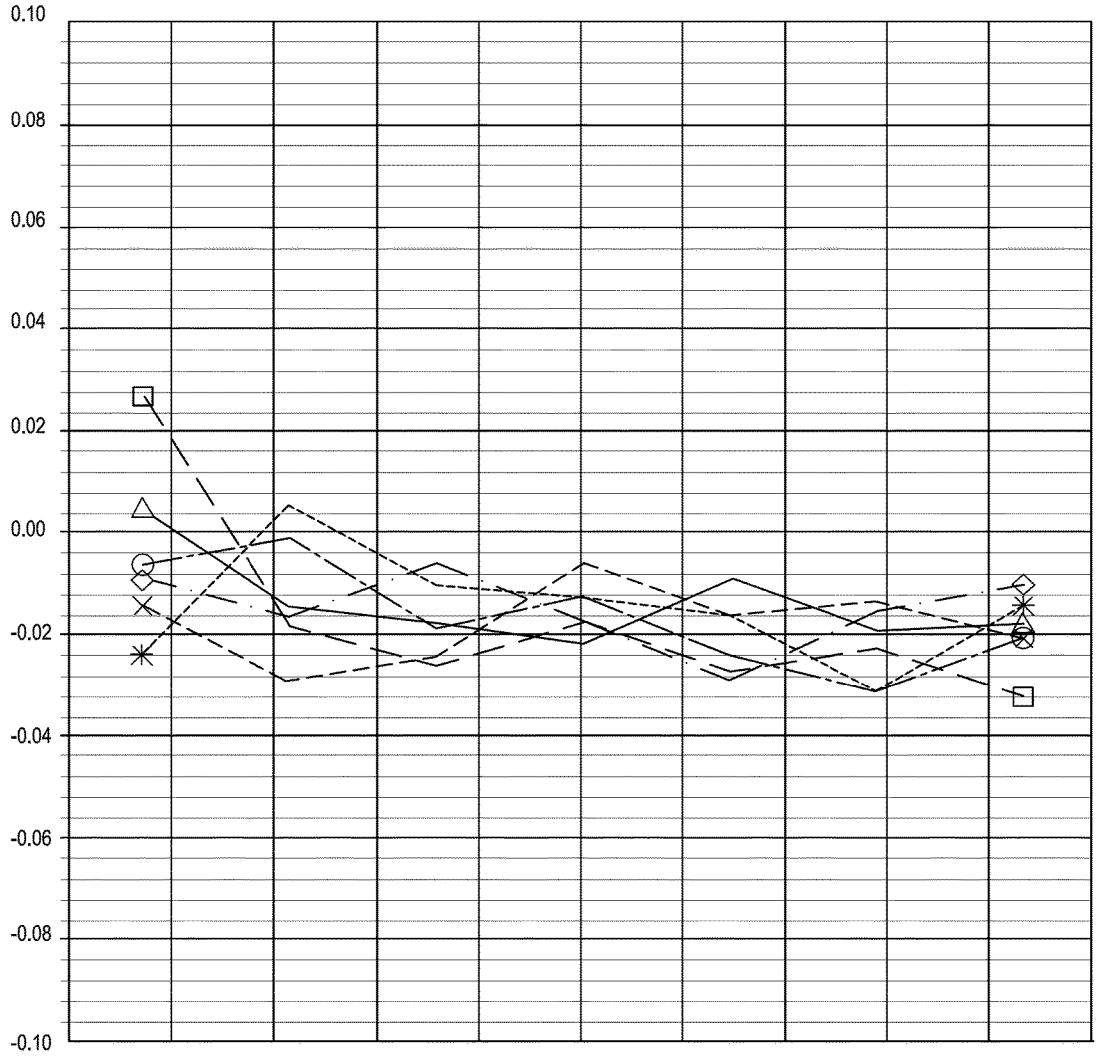

FIG. 11 reports the difference between the measured chord dimensions at different locations along the airfoil profile with respect to the initial dimension (i.e. the dimension prior to polishing) for the six samples under test. FIG. 11 shows that also for this set of tests the polishing process achieves a roughness far below 0.2 μm without adversely affecting the geometry of the profile. The dimensional alteration is reported in mm on the vertical axis. The position along the airfoil portion is reported on the horizontal axis.

The following Tables 10, 11, 12 and 13 report the measured arithmetic average roughness values on the suction side and the pressure side before polishing (Tables 10 and 11) and after the polishing (Tables 12 and 13) for six rotor blade samples (S/N 1, 35, 7, 19, 29, 26) belonging to the $11^{th}$ turbine stage:

TABLE 10

| S/N | S1 | S2 | S3 | S4 | S5 | S6 | Avg |
|---|---|---|---|---|---|---|---|
| 1 | 0.450 | 0.500 | 0.560 | 0.510 | 0.500 | 0.550 | 0.512 |
| 35 | 0.620 | 0.570 | 0.730 | 0.510 | 0.520 | 0.690 | 0.607 |
| 7 | 0.500 | 0.590 | 0.580 | 0.500 | 0.480 | 0.610 | 0.543 |
| 19 | 0.600 | 0.570 | 0.540 | 0.520 | 0.580 | 0.550 | 0.560 |
| 29 | 0.520 | 0.500 | 0.580 | 0.540 | 0.470 | 0.540 | 0.525 |
| 26 | 0.550 | 0.590 | 0.530 | 0.510 | 0.490 | 0.580 | 0.542 |

TABLE 11

| S/N | P1 | P2 | P3 | P4 | Avg |
|---|---|---|---|---|---|
| 1 | 0.450 | 0.470 | 0.450 | 0.510 | 0.470 |
| 35 | 0.540 | 0.520 | 0.530 | 0.600 | 0.548 |
| 7 | 0.460 | 0.530 | 0.510 | 0.520 | 0.505 |
| 19 | 0.450 | 0.460 | 0.490 | 0.520 | 0.480 |
| 29 | 0.610 | 0.650 | 0.760 | 0.640 | 0.665 |
| 26 | 0.510 | 0.510 | 0.570 | 0.500 | 0.523 |

TABLE 12

| S/N | S1 | S2 | S3 | S4 | S5 | S6 | Avg |
|---|---|---|---|---|---|---|---|
| 1 | 0.130 | 0.150 | 0.190 | 0.180 | 0.170 | 0.140 | 0.160 |
| 35 | 0.120 | 0.140 | 0.200 | 0.170 | 0.160 | 0.110 | 0.150 |
| 7 | 0.120 | 0.140 | 0.180 | 0.190 | 0.160 | 0.160 | 0.158 |
| 19 | 0.130 | 0.140 | 0.120 | 0.170 | 0.190 | 0.160 | 0.152 |
| 29 | 0.140 | 0.120 | 0.160 | 0.150 | 0.120 | 0.110 | 0.133 |
| 26 | 0.090 | 0.090 | 0.160 | 0.130 | 0.120 | 0.110 | 0.117 |

TABLE 13

| S/N | P1 | P2 | P3 | P4 | Avg |
|---|---|---|---|---|---|
| 1 | 0.130 | 0.150 | 0.180 | 0.210 | 0.168 |
| 35 | 0.130 | 0.110 | 0.150 | 0.240 | 0.158 |
| 7 | 0.110 | 0.170 | 0.120 | 0.150 | 0.138 |
| 19 | 0.130 | 0.140 | 0.130 | 0.160 | 0.140 |
| 29 | 0.110 | 0.110 | 0.090 | 0.100 | 0.103 |
| 26 | 0.110 | 0.090 | 0.150 | 0.130 | 0.120 |

Figure 12:
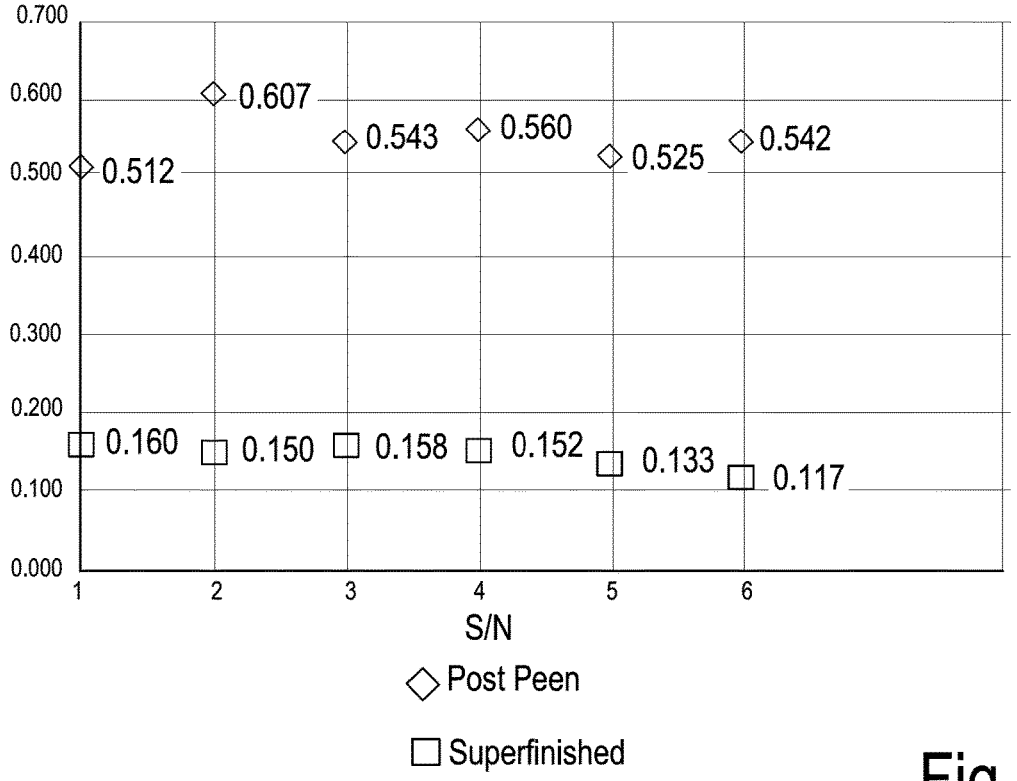
Figure 13:
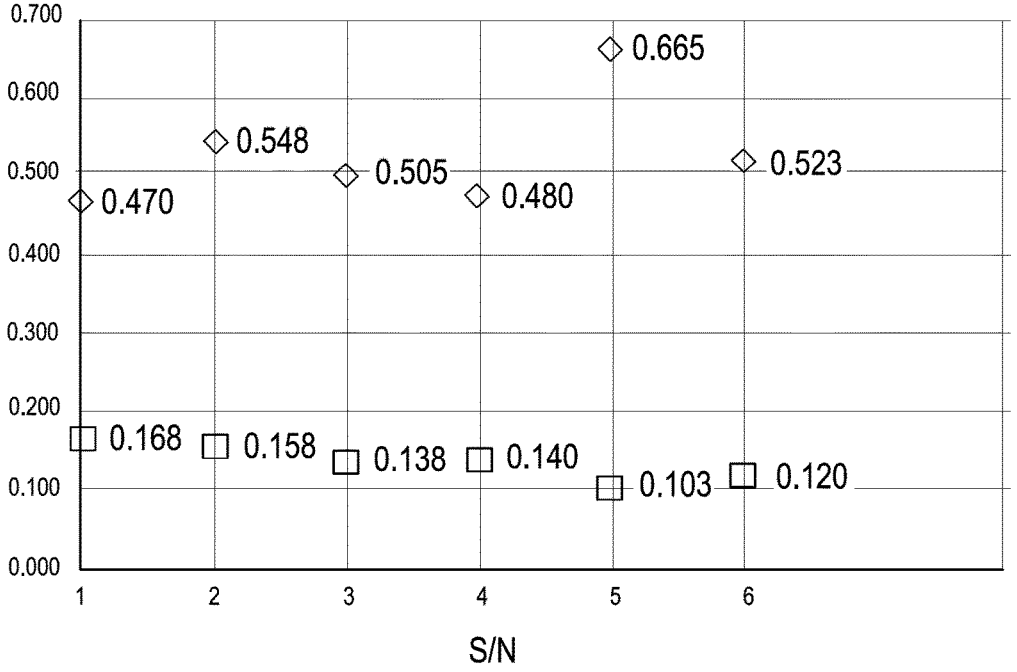
Figure 14:
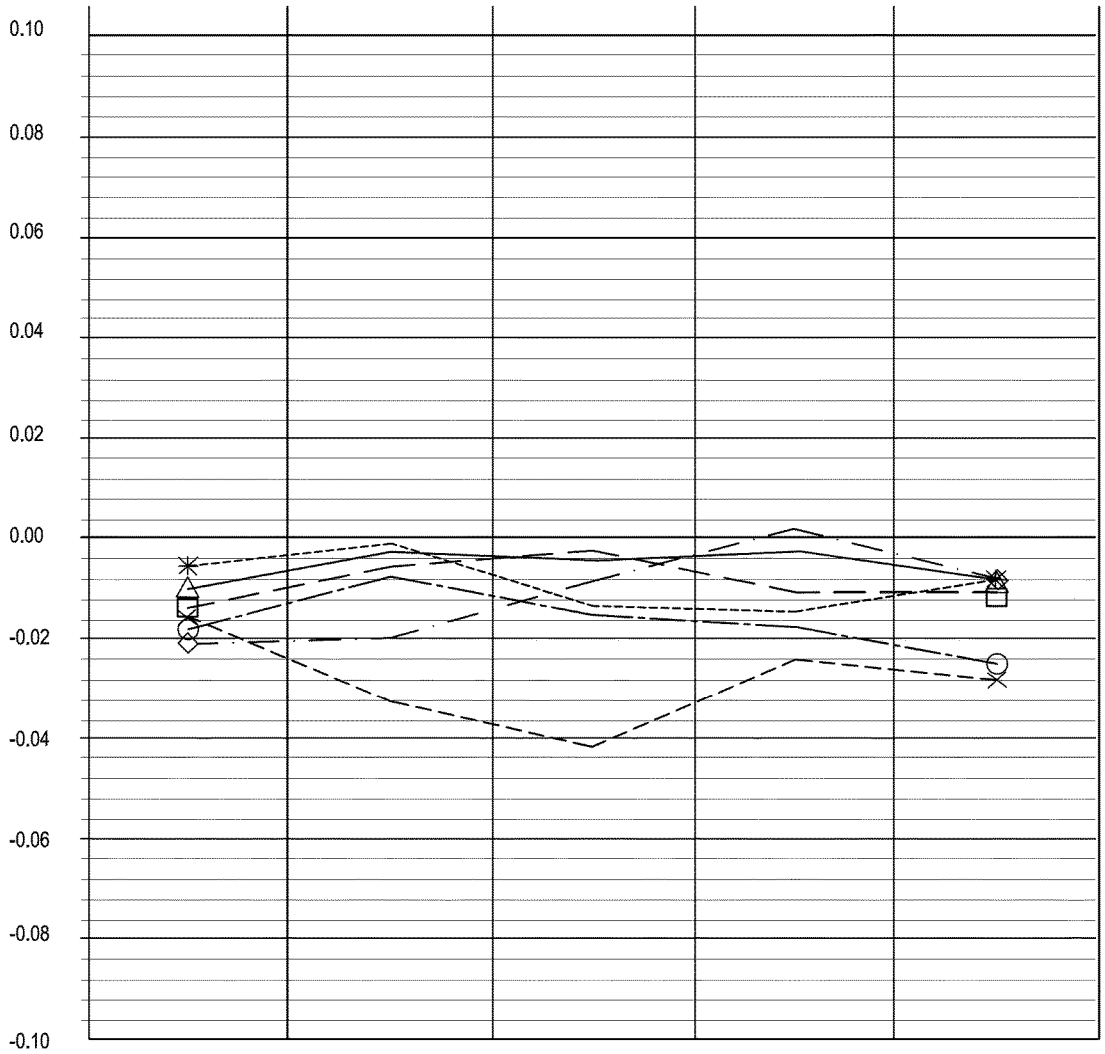

The arithmetic average roughness data reported in the above tables are summarized in the diagrams of FIGS. 12 and 13. FIG. 14 illustrates, similarly to FIGS. 8 and 11, the alteration of the chord dimension following the finishing or polishing process, at different locations along the airfoil profile, starting from the root towards the tip.

Tests performed on sample blades or buckets on $5^{th}$, $8^{th}$ and $16^{th}$ stator stage of the same turbine show similar results in terms of roughness values achieved and insignificant alteration of the blade geometry. The following Tables 14, 15, 16 and 17 report the measured roughness data on the suction side (Table 14) and pressure side (Table 15) before polishing and the roughness values on the suction side (Table 16) and on the pressure side (Table 17) after polishing, respectively.

TABLE 14

| S/N | S1 | S2 | S3 | S4 | S5 | S6 | Avg |
|---|---|---|---|---|---|---|---|
| 6 | 1.370 | 1.530 | 1.800 | 1.630 | 1.450 | 1.432 | 1.535 |
| 50 | 1.480 | 1.290 | 1.550 | 1.560 | 1.550 | 1.500 | 1.488 |
| 70 | 1.370 | 1.470 | 1.660 | 1.410 | 1.400 | 1.410 | 1.453 |
| 52 | 1.460 | 1.520 | 1.630 | 1.550 | 1.400 | 1.480 | 1.507 |
| 9 | 1.460 | 1.450 | 1.690 | 1.420 | 1.430 | 1.620 | 1.512 |
| 81 | 1.470 | 1.430 | 1.560 | 1.670 | 1.370 | 1.520 | 1.503 |

TABLE 15

| S/N | P1 | P2 | P3 | P4 | Avg |
|---|---|---|---|---|---|
| 6 | 1.440 | 1.370 | 1.430 | 1.450 | 1.423 |
| 50 | 1.360 | 1.390 | 1.480 | 1.460 | 1.423 |
| 70 | 1.330 | 1.600 | 1.440 | 1.610 | 1.495 |
| 52 | 1.390 | 1.260 | 1.450 | 1.460 | 1.390 |
| 9 | 1.420 | 1.420 | 1.600 | 1.550 | 1.498 |
| 81 | 1.360 | 1.610 | 1.310 | 1.560 | 1.460 |

TABLE 16

| S/N | S1 | S2 | S3 | S4 | S5 | S6 | Avg |
|---|---|---|---|---|---|---|---|
| 6 | 0.140 | 0.170 | 0.150 | 0.120 | 0.160 | 0.170 | 0.152 |
| 50 | 0.150 | 0.170 | 0.180 | 0.120 | 0.110 | 0.170 | 0.150 |
| 70 | 0.140 | 0.160 | 0.180 | 0.190 | 0.150 | 0.150 | 0.162 |
| 52 | 0.120 | 0.140 | 0.150 | 0.160 | 0.180 | 0.160 | 0.152 |
| 9 | 0.100 | 0.130 | 0.150 | 0.170 | 0.170 | 0.100 | 0.137 |
| 81 | 0.100 | 0.120 | 0.150 | 0.180 | 0.190 | 0.090 | 0.138 |

TABLE 17

| S/N | P1 | P2 | P3 | P4 | Avg |
|---|---|---|---|---|---|
| 6 | 0.110 | 0.100 | 0.120 | 0.120 | 0.113 |
| 50 | 0.130 | 0.120 | 0.160 | 0.112 | 0.131 |
| 70 | 0.110 | 0.100 | 0.090 | 0.100 | 0.100 |
| 52 | 0.100 | 0.130 | 0.140 | 0.120 | 0.123 |

TABLE 17-continued

| S/N | P1 | P2 | P3 | P4 | Avg |
|---|---|---|---|---|---|
| 9 | 0.090 | 0.110 | 0.120 | 0.140 | 0.115 |
| 81 | 0.100 | 0.090 | 0.120 | 0.130 | 0.110 |

Figure 15:
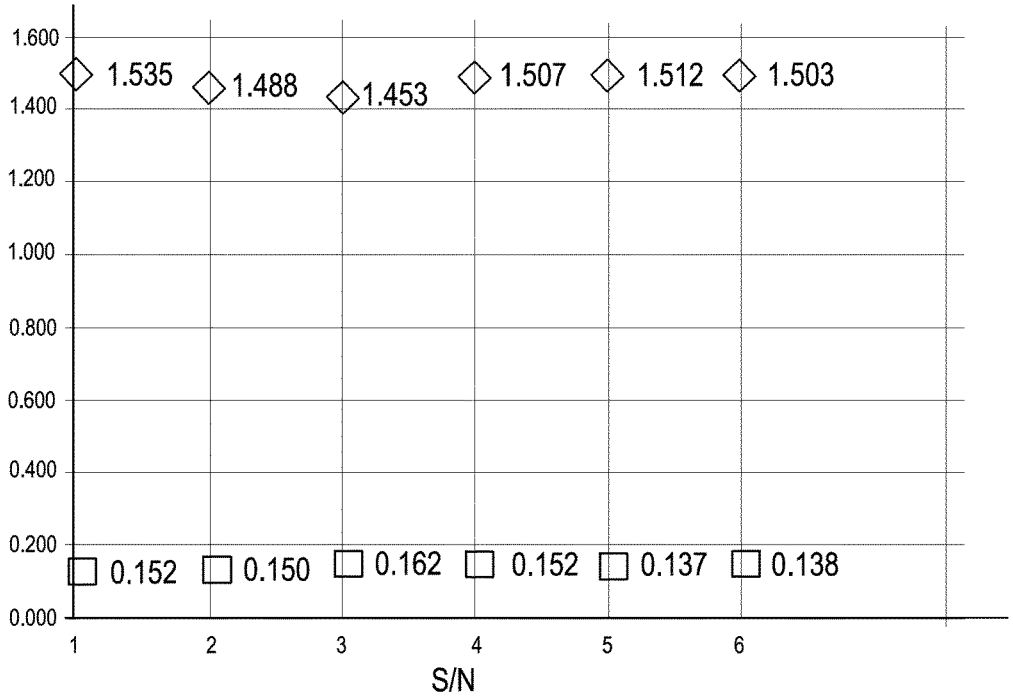
Figure 16:
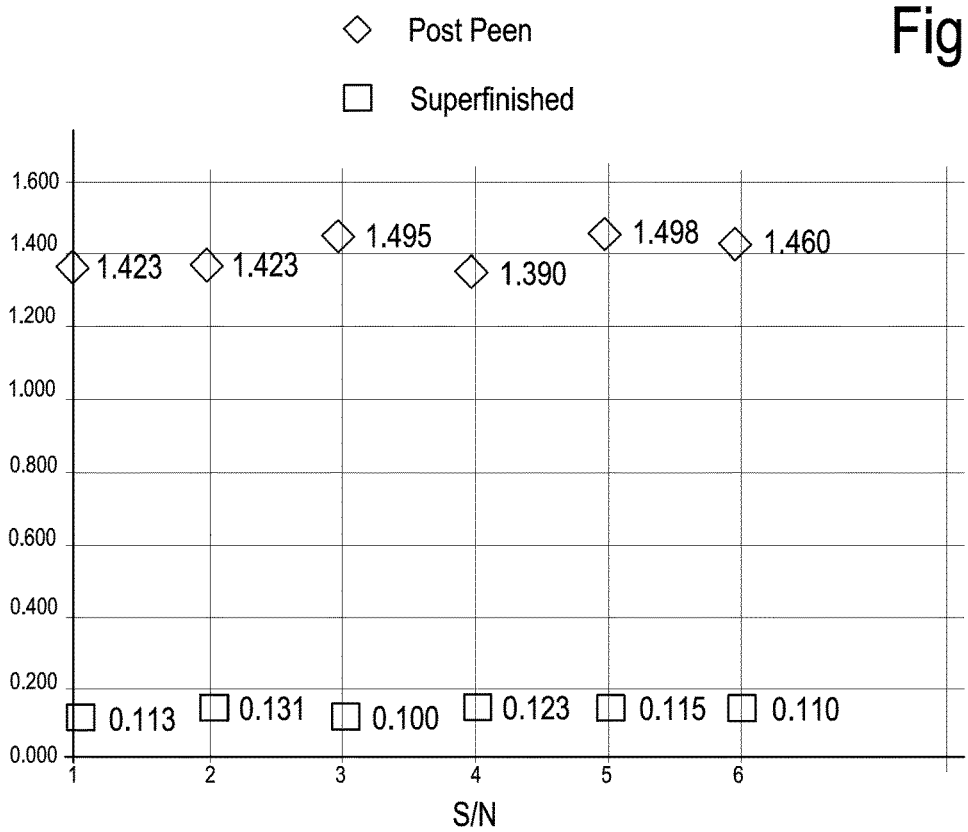

Arithmetic average roughness values around or below 0.15 μm are obtained on both pressure side and suction side of the buckets. FIGS. 15 and 16 summarize the data on the arithmetic average roughness before and after polishing, respectively on the suction side and pressure side.

Figure 17:
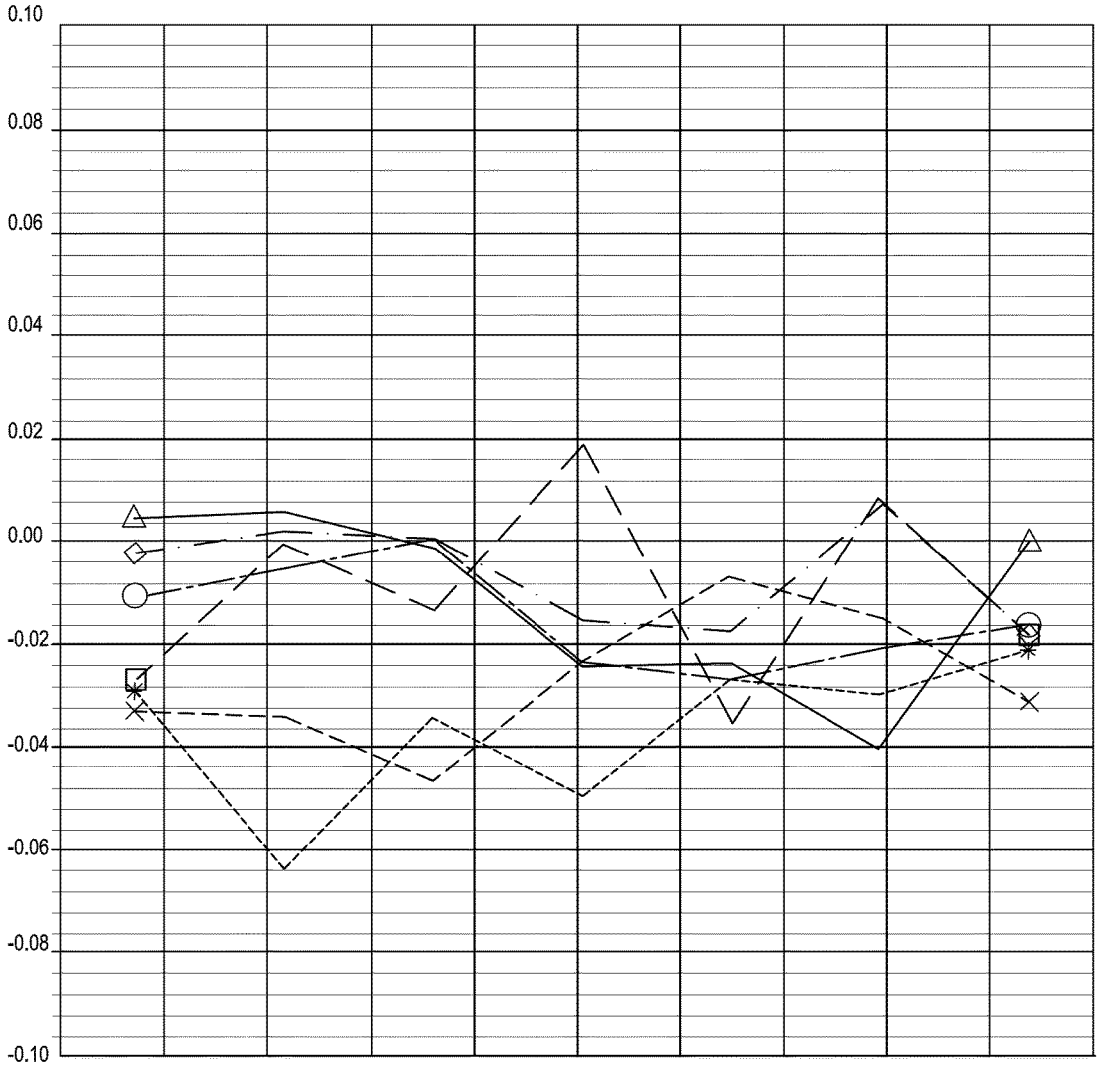

FIG. 17 shows the chord dimension alterations with respect to the initial value, i.e. before polishing, at seven different locations along the height of the blade after polishing. As for the rotor blades discussed above, also in the case of the stator bucket of the $5^{th}$ stage the polishing process has substantially no effect on the overall geometry of the blade.

Figure 18:
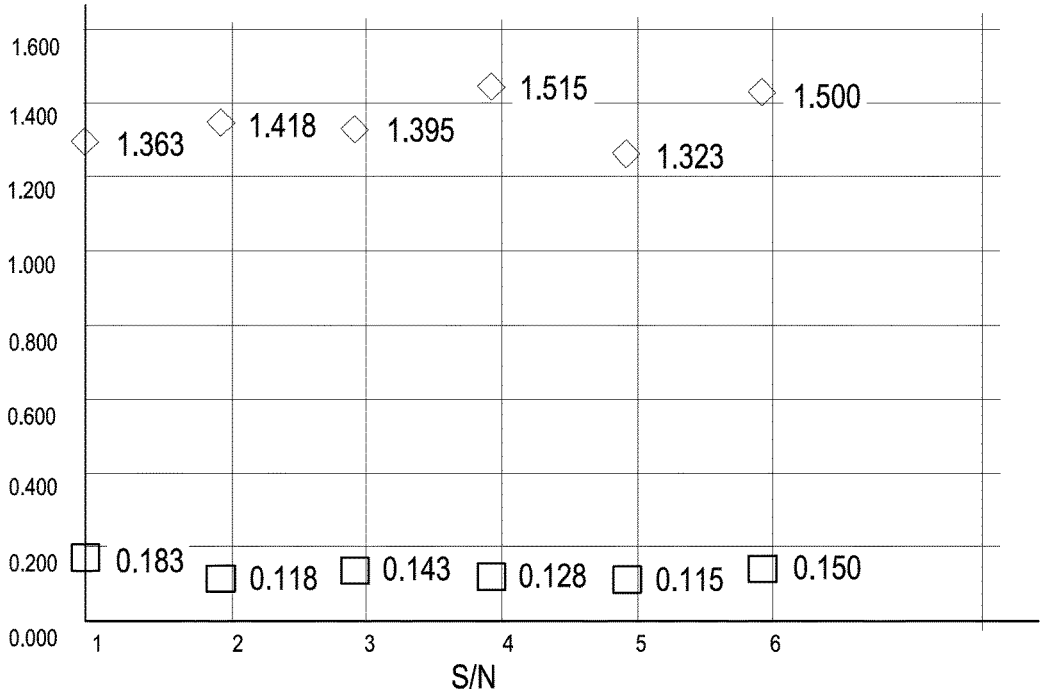
Figure 19:
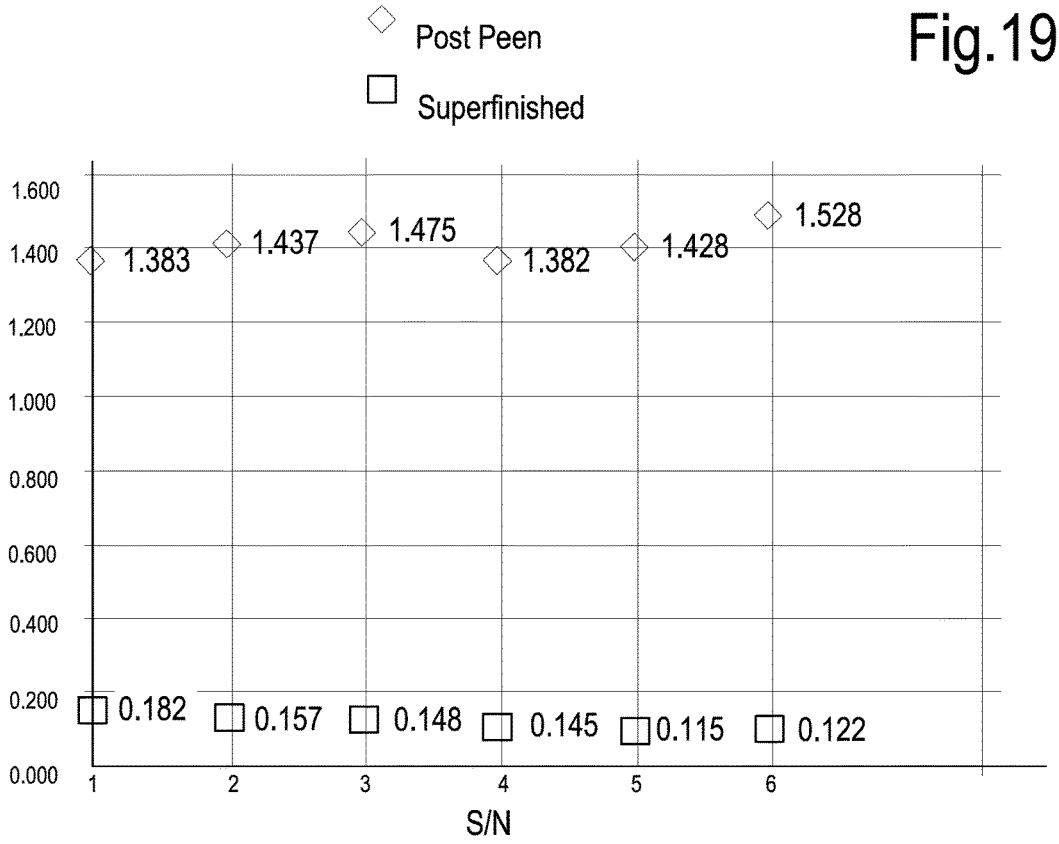

The following Tables 18, 19, 20 and 21 show the roughness measurements before polishing (Table 18—suction side, Table 19—pressure side) and after polishing (Table 20—suction side, Table 21—pressure side) for six different samples of stator buckets of the $8^{th}$ stage of the turbine. Arithmetic average roughness values under 0.2 μm, mainly around or below 0.15 μm are obtained. The arithmetic average roughness values (before and after polishing) on the suction side and the pressure side are depicted and summarized in FIGS. 18 and 19, respectively.

TABLE 18

| S/N | S1 | S2 | S3 | S4 | S5 | S6 | Avg |
|---|---|---|---|---|---|---|---|
| 26 | 1.270 | 1.410 | 1.250 | 1.530 | 1.390 | 1.450 | 1.383 |
| 41 | 1.260 | 1.590 | 1.580 | 1.600 | 1.280 | 1.310 | 1.437 |
| 52 | 1.300 | 1.380 | 1.740 | 1.620 | 1.330 | 1.480 | 1.475 |
| 58 | 1.310 | 1.330 | 1.450 | 1.520 | 1.410 | 1.270 | 1.382 |
| 6 | 1.390 | 1.430 | 1.460 | 1.570 | 1.360 | 1.360 | 1.428 |
| 39 | 1.400 | 1.450 | 1.690 | 1.780 | 1.320 | 1.530 | 1.528 |

TABLE 19

| S/N | P1 | P2 | P3 | P4 | Avg |
|---|---|---|---|---|---|
| 26 | 1.210 | 1.540 | 1.260 | 1.440 | 1.363 |
| 41 | 1.280 | 1.500 | 1.540 | 1.350 | 1.418 |
| 52 | 1.340 | 1.400 | 1.320 | 1.520 | 1.395 |
| 58 | 1.250 | 1.530 | 1.650 | 1.630 | 1.515 |
| 6 | 1.210 | 1.380 | 1.320 | 1.380 | 1.323 |
| 39 | 1.310 | 1.410 | 1.610 | 1.670 | 1.500 |

TABLE 20

| S/N | S1 | S2 | S3 | S4 | S5 | S6 | Avg |
|---|---|---|---|---|---|---|---|
| 26 | 0.180 | 0.210 | 0.190 | 0.160 | 0.140 | 0.210 | 0.182 |
| 41 | 0.120 | 0.130 | 0.160 | 0.180 | 0.170 | 0.180 | 0.157 |
| 52 | 0.130 | 0.160 | 0.150 | 0.150 | 0.180 | 0.120 | 0.148 |
| 58 | 0.120 | 0.150 | 0.150 | 0.170 | 0.160 | 0.120 | 0.145 |
| 6 | 0.090 | 0.120 | 0.150 | 0.100 | 0.130 | 0.100 | 0.115 |
| 39 | 0.120 | 0.150 | 0.150 | 0.110 | 0.110 | 0.090 | 0.122 |

TABLE 21

| S/N | P1 | P2 | P3 | P4 | Avg |
|---|---|---|---|---|---|
| 26 | 0.170 | 0.220 | 0.180 | 0.160 | 0.183 |
| 41 | 0.110 | 0.100 | 0.130 | 0.130 | 0.118 |
| 52 | 0.130 | 0.130 | 0.160 | 0.150 | 0.143 |

TABLE 21-continued

| S/N | P1 | P2 | P3 | P4 | Avg |
|---|---|---|---|---|---|
| 58 | 0.120 | 0.150 | 0.130 | 0.110 | 0.128 |
| 6 | 0.100 | 0.120 | 0.100 | 0.140 | 0.115 |
| 39 | 0.110 | 0.110 | 0.200 | 0.180 | 0.150 |

Figure 20:
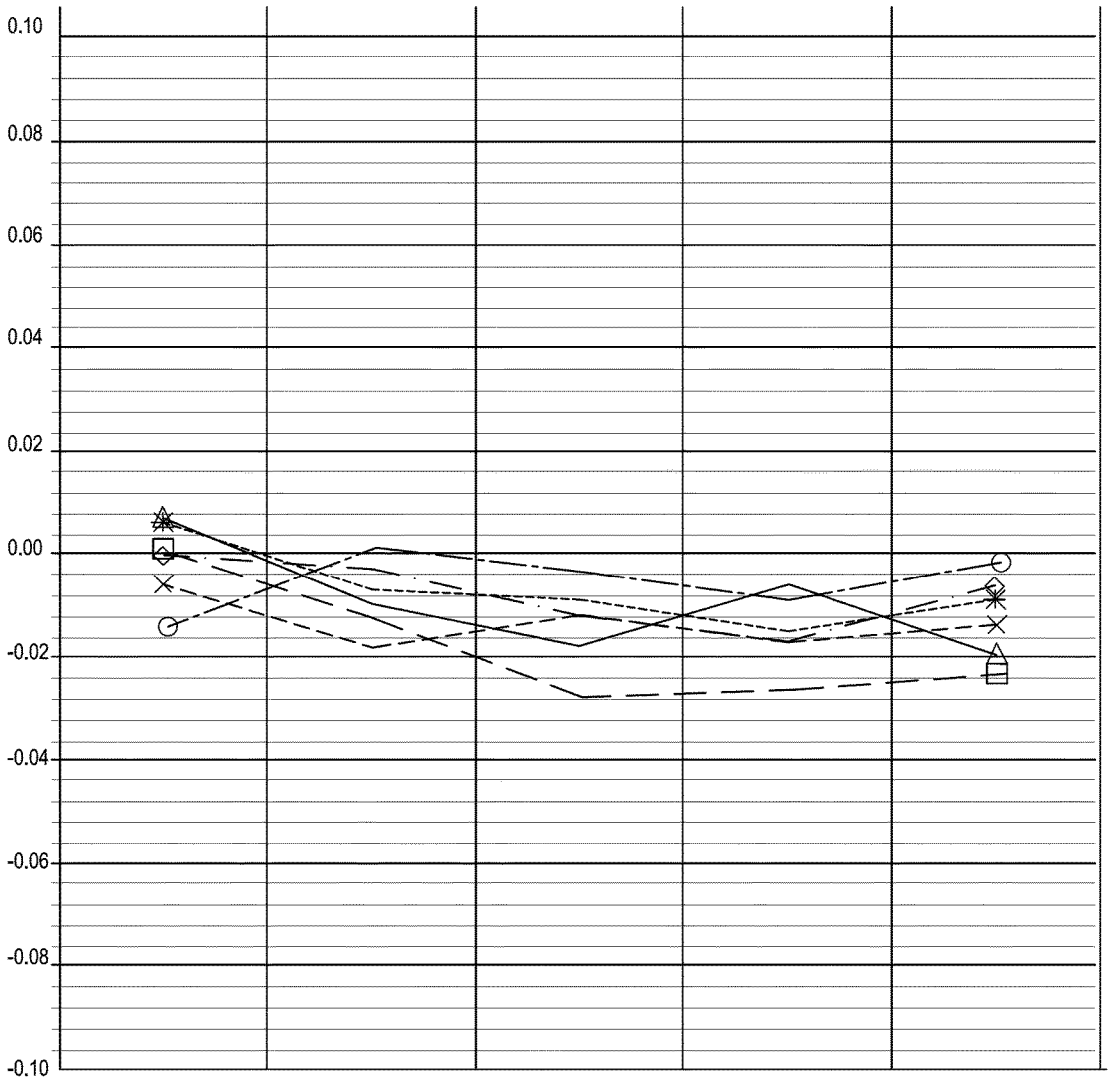

FIG. 20, similarly to FIGS. 17 and 14, report the alteration of the chord extension due to the polishing process. The data reported in FIG. 20 show that also in this case the polishing process has substantially no effect on the geometry of the airfoil profile, i.e. the geometry of the blades and buckets remain substantially unaltered and they consequently maintain their functionality substantially unaltered.

Finally, Tables 22, 23, 24 and 25 report the arithmetic average roughness values measured on the suction side and pressure side before polishing (Table 22—suction side; Table 23—pressure side) and after polishing (Table 24—suction side; Table 25—pressure side) for six stator bucket samples of the $16^{th}$ stage of the turbine.

TABLE 22

| S/N | S1 | S2 | S3 | S4 | S5 | S6 | Avg |
|---|---|---|---|---|---|---|---|
| 27 | 1.620 | 1.660 | 1.400 | 1.520 | 1.610 | 1.530 | 1.557 |
| 26 | 1.710 | 1.690 | 1.610 | 1.630 | 1.720 | 1.530 | 1.648 |
| 85 | 1.570 | 1.510 | 1.570 | 1.760 | 1.700 | 1.700 | 1.635 |
| 98 | 1.750 | 1.810 | 1.630 | 1.630 | 1.930 | 1.750 | 1.750 |
| 114 | 1.630 | 1.450 | 1.420 | 1.480 | 1.560 | 1.620 | 1.527 |
| 119 | 1.600 | 1.560 | 1.490 | 1.590 | 1.500 | 1.590 | 1.555 |

TABLE 23

| S/N | P1 | P2 | P3 | P4 | Avg |
|---|---|---|---|---|---|
| 27 | 1.740 | 1.700 | 1.840 | 2.170 | 1.863 |
| 26 | 1.740 | 2.010 | 1.900 | 1.830 | 1.870 |
| 85 | 1.580 | 1.750 | 1.690 | 1.970 | 1.748 |
| 98 | 2.060 | 1.830 | 1.840 | 1.820 | 1.888 |
| 114 | 1.800 | 1.850 | 1.720 | 1.880 | 1.813 |
| 119 | 1.710 | 1.700 | 1.960 | 1.930 | 1.825 |

TABLE 24

| S/N | S1 | S2 | S3 | S4 | S5 | S6 | Avg |
|---|---|---|---|---|---|---|---|
| 27 | 0.180 | 0.150 | 0.190 | 0.160 | 0.130 | 0.180 | 0.165 |
| 26 | 0.210 | 0.180 | 0.160 | 0.200 | 0.190 | 0.190 | 0.188 |
| 85 | 0.190 | 0.200 | 0.150 | 0.150 | 0.170 | 0.210 | 0.178 |
| 98 | 0.190 | 0.190 | 0.160 | 0.150 | 0.180 | 0.180 | 0.175 |
| 114 | 0.140 | 0.170 | 0.150 | 0.170 | 0.160 | 0.130 | 0.153 |
| 119 | 0.140 | 0.150 | 0.190 | 0.180 | 0.140 | 0.130 | 0.155 |

TABLE 25

| S/N | P1 | P2 | P3 | P4 | Avg |
|---|---|---|---|---|---|
| 27 | 0.180 | 0.160 | 0.210 | 0.160 | 0.178 |
| 26 | 0.150 | 0.120 | 0.180 | 0.190 | 0.160 |
| 85 | 0.160 | 0.140 | 0.170 | 0.150 | 0.155 |
| 98 | 0.130 | 0.140 | 0.160 | 0.140 | 0.143 |
| 114 | 0.140 | 0.110 | 0.140 | 0.140 | 0.133 |
| 119 | 0.150 | 0.170 | 0.160 | 0.150 | 0.158 |

Figure 21:
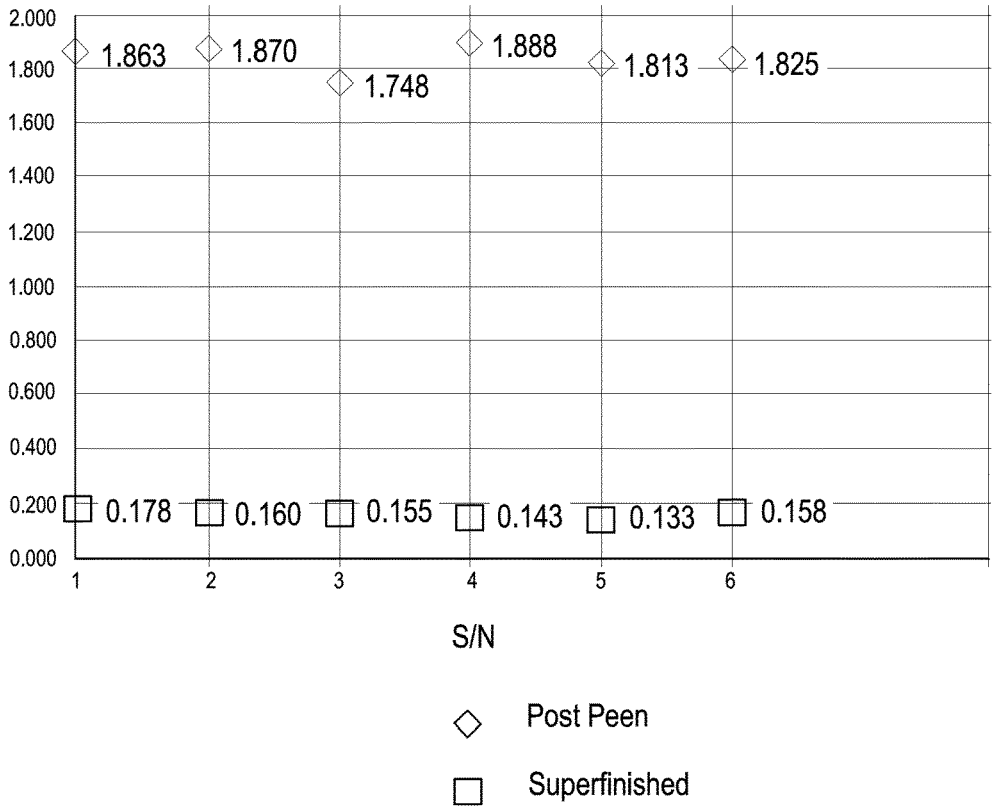
Figure 22:
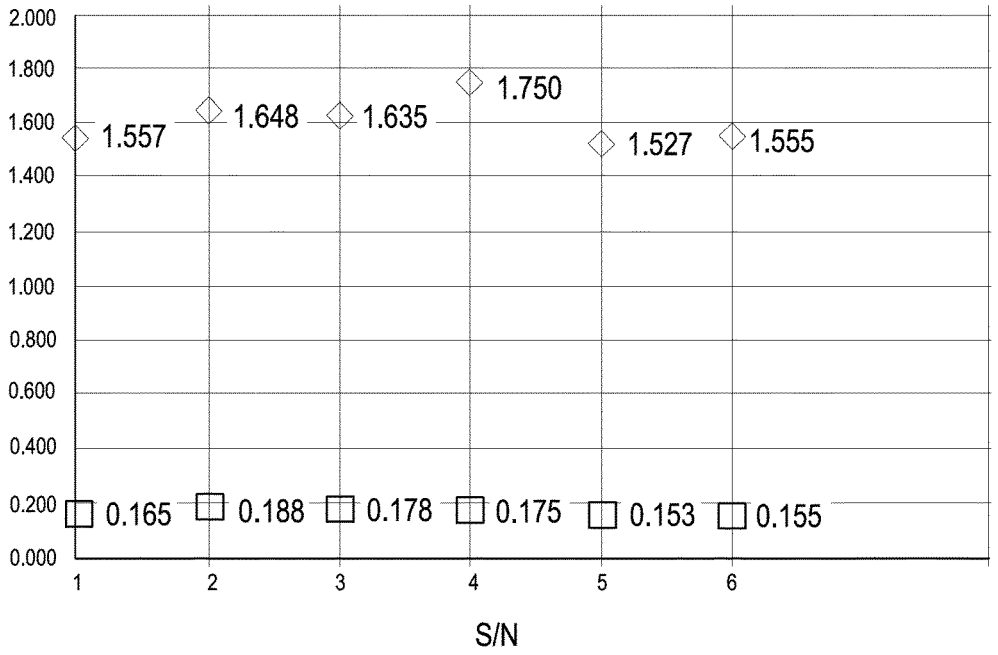

FIGS. 21 and 22 summarize the arithmetic average roughness values on the suction side and pressure side, respectively, for the stator buckets of the $16^{th}$ stage. Arithmetic average roughness values far below 0.2 μm are achieved also in this case.

Figure 23:
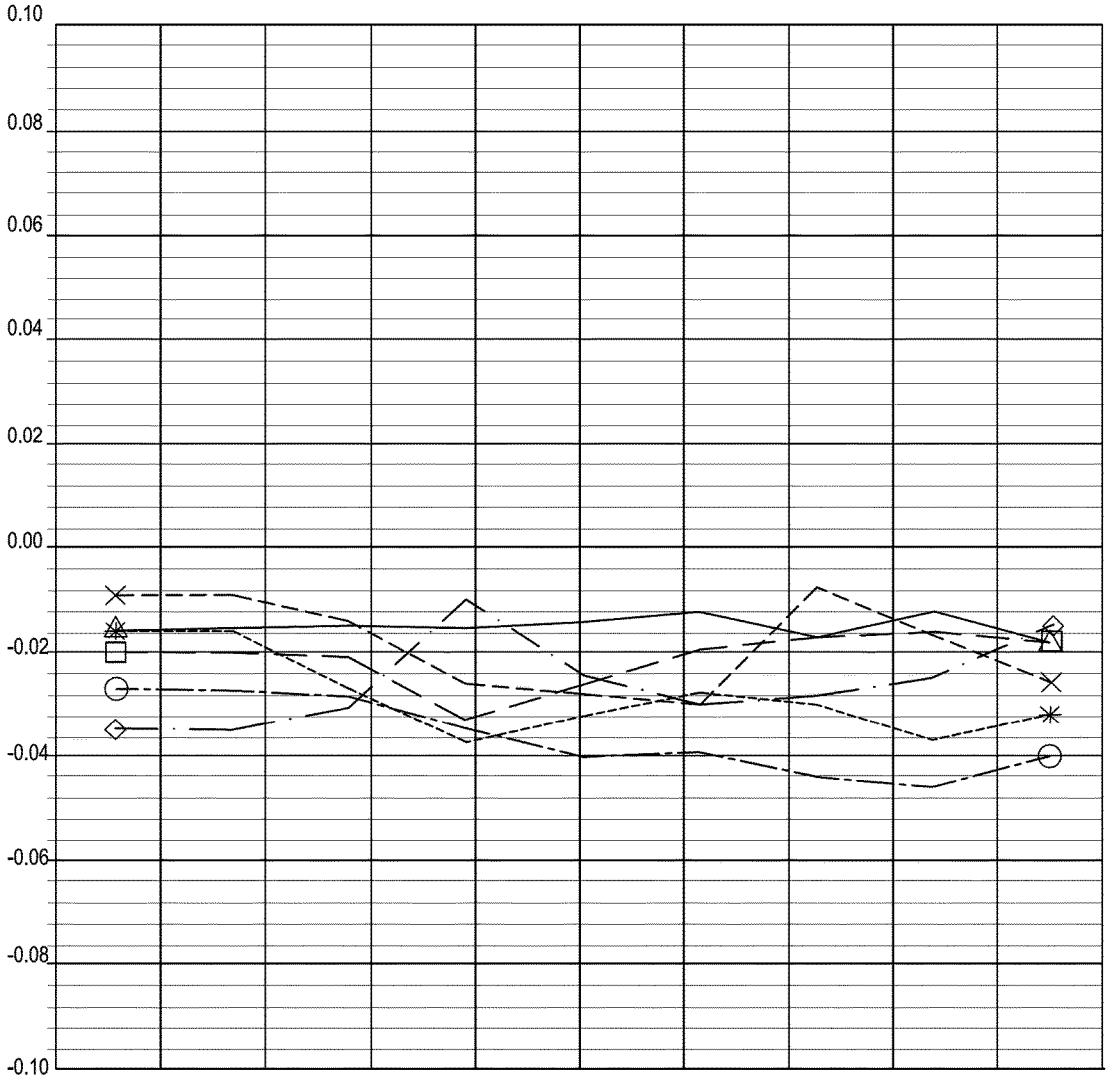

The diagram of FIG. 23 shows the substantial lack of effect of the polishing process on the geometry of the buckets, the chord dimension whereof remains substantially unaffected.

Polishing of Impellers

The above described polishing method may be used for polishing impellers for centrifugal compressors, pumps and radial or axial-radial turbomachines in general.

An exemplary embodiment of such an impeller is shown in FIG. 24. The impeller, designated 30 as a whole, comprises a hub 31 and a shroud 33. A plurality of blades 35 are arranged between the hub 31 and the shroud 33. Between adjacent blades 35 respective flow vanes 37 are defined. The blades 35 constitute airfoil portions of this machine component and are each provided with a leading edge 35A and a trailing edge 35B. The fluid inlet is defined at the inlet side of the impeller, where the leading edges 35A are arranged. Pressurized fluid is discharged radially at the discharge side of the impeller 30, between the trailing edges 35B of the blades 35.

In some embodiments the shroud 33 forms a stepped outer profile for co-action with a sealing arrangement arranged in the stationary casing, where the impeller 30 is supported for rotation.

In FIG. 25 an impeller 30 is shown during the polishing step. The apparatus for performing the polishing step is labeled 10 and can be substantially the same as disclosed with respect to FIG. 2. During the polishing step the impeller 30 is constrained to the container 11 and vibrates therewith when the motor 21 rotates and causes vibration of the vibrating table 13.

By tuning the frequency of the vibration, a frequency can be set at which the metal particles contained in the polishing mixture M slide along the inner and outer surfaces of the impeller 30 and in particular circulate inside the vanes 37. Abrasive powder between the treated surface of the impeller 30 and the metal particles is thus caused to act upon the treated surface due to the sliding movement of the metal particles along the surfaces under treatment, quite in the same way as described above in connection with FIG. 3. A substantially continuous flow of polishing mixture M is established around the impeller 30 and through the vanes 37. The entire inner and outer surfaces of the impeller 30 are thus polished, in particular the pressure side and the suction side of each blade 35, as well as the inner shroud surface and the inner hub surface, which along with the blade surfaces define the flow channels through which the fluid is processed when the impeller rotates in the turbomachine.

Contrary to what happens in abrasive flow machining procedures of the current art polishing processes, the polishing mixture M flows through the vanes of the impeller 30 at substantially no pressure, so that the geometry of the impeller remains unaffected by the polishing particles acting thereon, while the gentle treatment obtained by the displacement of the metal particles with the abrasive powder thereon along the impeller surfaces causes a substantial reduction of the arithmetic average roughness of the inner and outer surfaces of the impeller.

Example 2

The following data have been obtained on a sample of a 2D centrifugal compressor impeller treated with the above described polishing process. These data show that the process is capable of reaching very low arithmetic average roughness values (Ra) without adversely affecting the geometry of the critical parts of the impeller, in particular the blades, defining the airfoil profiles of the impeller.

The polishing process was performed with a polishing mixture having the following composition:

Metal particles (copper): 93.67% wt
Abrasive (aluminum oxide): 0.24% wt
Polishing medium (soap): 0.47% wt
Water: 5.62% wt The impeller was maintained under vibration for 7 hours and 30 minutes.

The following Table 26 reports the arithmetic average roughness measured before and after polishing in three different points along a vane between adjacent blades of the impeller, starting from the impeller outlet. The measurements were carried out on three different points at 10, 44 and 75 mm from the impeller outlet in radial direction.

Since measurement requires partial removal of the shroud, the measurements before and after polishing were carried out on different vanes. The shroud portion was first removed from one vane to get access to the interior thereof. After polishing a further shroud portion was removed from a different vane, so that the polishing treatment of the vane under measurement was performed with the vane being closed by the shroud.

TABLE 26

| | distance from exit [mm] | measure direction | Ra before polishing [□m] | Ra after polishing [□m] |
|---|---|---|---|---|
| Point 1 | 10 | Radial | 0.87 | 0.14 |
| Point 2 | 44 | Radial | 0.76 | 0.27 |
| Point 3 | 75 | Radial | 0.94 | 0.25 |

Figure 26:
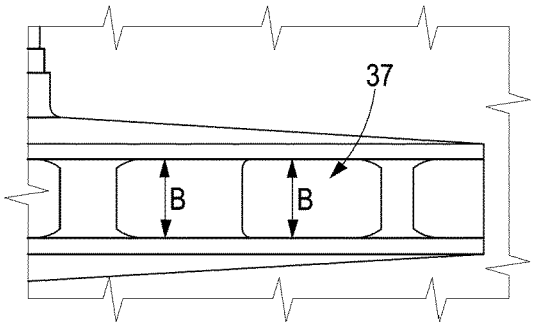
FIGS. 26, 27 and 28 illustrate locations of measurements made on a sample impeller polished with a method according to the present disclosure.

The axial dimension of the impeller outlet and the blade thickness were used as significant parameters for checking the effect of the polishing process on the overall geometry of the blade. FIG. 26 shows an enlargement of an outlet of a vane 37 of the impeller 30. The dimension B, i.e. the height in the axial direction of the outlet, has been measured in different locations for different vanes of the impeller.

The difference on the measurements before and after polishing is negligible and below the sensitivity (0.005 mm) of the instrument used, in both vanes considered and for all measurement locations.

The following Table 27 shows the thickness of three blades of the same impeller measured at the trailing edge thereof. The table reports the blade thickness before and after polishing. The difference between the measurements before and after treatment is negligible.

TABLE 27

| blade width | Difference [mm] |
|---|---|
| BLADE 1 | 0.005 |
| BLADE 2 | 0.017 |
| BLADE 3 | 0.006 |

These data show that the polishing process has substantially no effect on the geometry of the impeller and of the profile of the blades.

Example 3

A 3D impeller made of carbon steel schematically shown in FIGS. 27 to 29 has been subject to a polishing process with a polishing mixture composed as follows:

Metal particles (copper): 96% wt
Abrasive (aluminum oxide): 0.25% wt
Polishing medium (soap): 0.20% wt
Water: 3.55% wt The process was performed for 6 hours in a polishing machine 10 as shown in FIG. 25.

Figure 27:
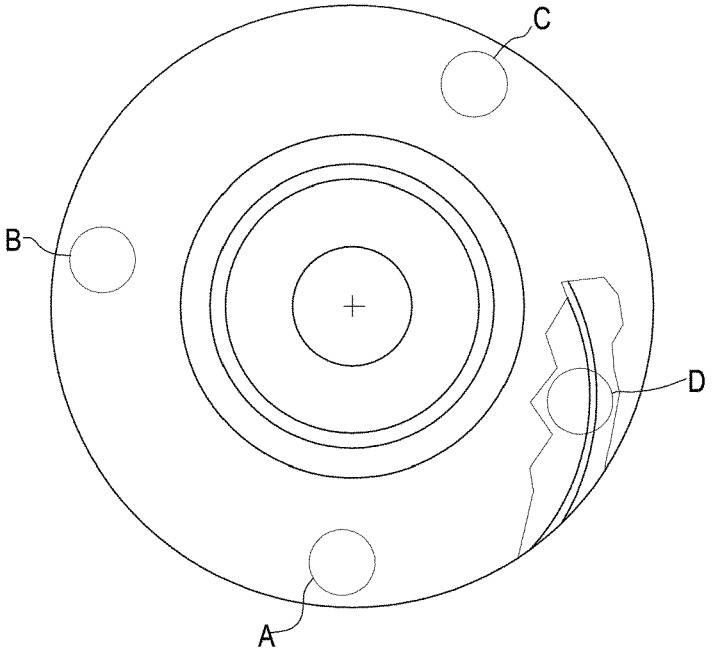
Figure 28:
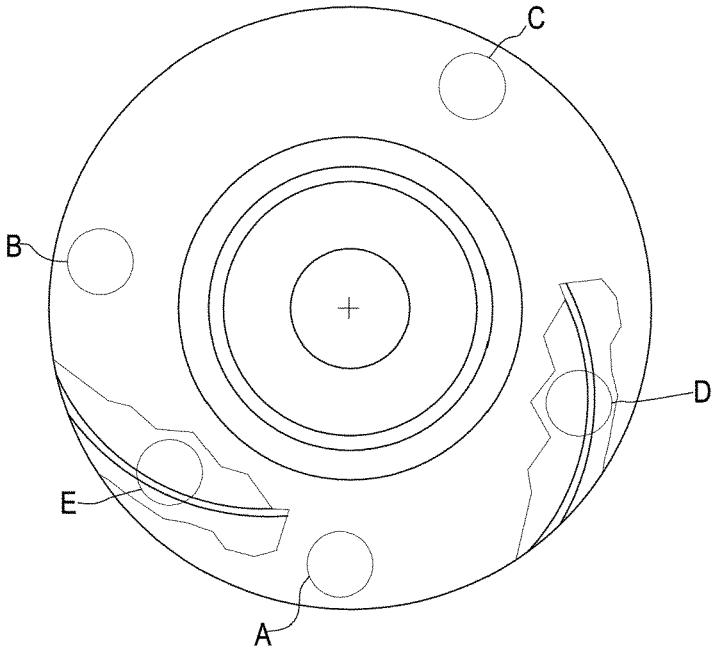

FIG. 27 shows a top axial view of the impeller prior to the polishing step. Letters A, B, C and D indicate four areas where the arithmetic average roughness Ra was measured before treatment. The area D is inside one of the vanes of the impeller. A portion of the impeller shroud has been removed for measurement purposes, as shown in FIG. 27. FIG. 28 illustrates a view similar to FIG. 27, with a further shroud portion removed, to get access to an area labeled E, inside a further impeller vane. The area E has been made accessible for measuring the roughness thereof by removing the relevant shroud portion after polishing.

Table 28 show the arithmetic average roughness measured in the areas A-D prior to polishing and in the areas A-E after polishing:

TABLE 28

| | Ra BEFORE Polishing (μm) | Ra AFTER Polishing (μm) |
|---|---|---|
| Area A | 2.06 | 0.16 |
| Area B | 1.78 | 0.10 |
| Area C | 2.40 | 0.12 |
| Area D | 2.51 | 0.13 |
| Area E | — | 0.10 |

Figure 29:
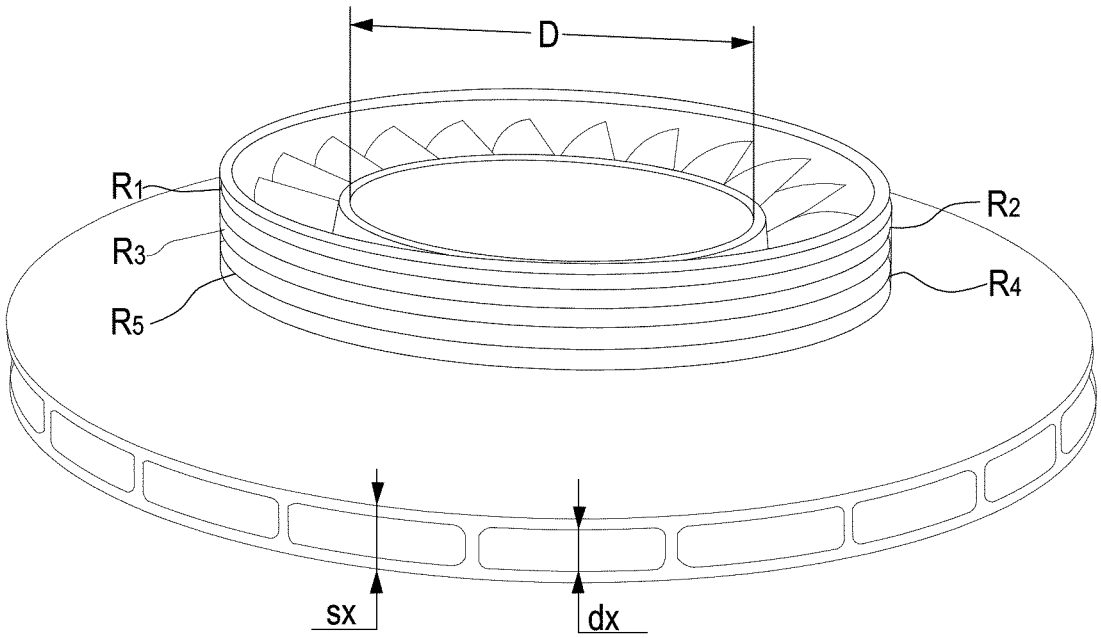
FIG. 29 illustrates a further impeller which can be polished with a method according to the disclosure.

As best shown in FIG. 29, the impeller has a plurality of sealing rings provided on the impeller eye. In FIG. 29 five rings are shown and labeled R1-R5. Reference numbers dx and sx indicate the height of the outlet aperture of one vane of the impeller and D indicates the inner diameter of the shaft passage provided in the impeller hub.

Measurements carried out on the dimensions of these parts of the impeller before and after polishing show that these critical impeller dimensions are not altered by the polishing process, in spite of the extremely low arithmetic average roughness values reached at the end of the polishing process (Table 28).

The following Table 29 summarize the measurements made before and after polishing on the inner diameter of the hub, on the diameter of the five sealing rings R1-R5, and on the axial dimensions dx and sx of the vane outlet, respectively:

TABLE 29

| | BEFORE [mm] | AFTER [mm] | CONSUMPTION [mm] |
|---|---|---|---|
| Inner Diameter | 127.016 | 127.035 | 0.019 |
| Diameter R1 | 209.975 | 209.947 | 0.028 |
| Diameter R2 | 211.978 | 211.944 | 0.034 |
| Diameter R3 | 213.979 | 213.939 | 0.040 |
| Diameter R4 | 215.981 | 215.937 | 0.044 |
| Diameter R5 | 217.983 | 217.937 | 0.046 |

As evidenced by the data reported in the above Table 29, the critical parts of the impeller remain unaffected by the polishing process, which reaches extremely low arithmetic average roughness values, around 0.1 μm.

Tolerances on the mean blade thickness are usually around +/−5% and the tolerances on the mean output width are around +/−3%. The measurements carried on the samples treated with the method disclosed herein show that the modification of these critical measures is negligible, and well below the acceptable tolerances.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A method for polishing a machine component, the method comprising:

arranging a machine component in a container and constraining the machine component to the container, the machine component comprising at least one airfoil portion comprised of a suction side, a pressure side, a leading edge, and a trailing edge;

adding a polishing mixture in the container, the polishing mixture containing at least abrasive powder, a liquid and metal particles; and vibrating the container and the machine component constrained thereto, thereby generating a polishing mixture flow along a surface of the airfoil portion until a final arithmetic average roughness equal to or less than 0.3 μm is achieved on at least a portion of the airfoil portion surface, wherein the dimension and shape of the airfoil portion in contact with the polishing mixture flow is substantially unaltered.

2. The method of claim 1, wherein a final arithmetic average roughness achieved is equal to or less than 0.2 μm.

3. The method of claim 1, wherein a final arithmetic average roughness achieved is equal to or less than 0.17 μm.

4. The method of claim 1, further comprising selecting a vibration frequency of the container and the machine component, wherein the selected vibration frequency causes the metal particles advancing along the airfoil portion to adhere to a surface of the airfoil portion while abrasive particles of the abrasive powder are trapped between the airfoil portion and the metal particles.

5. The method of claim 1, wherein the metal particles have substantially planar surfaces, and wherein the metal particles are advanced by vibration along the airfoil portion with the planar surfaces thereof in contact with the airfoil portion.

6. The method of claim 1, further comprising, prior to arranging the machine component in the container, subjecting the surface of the machine component to shot peening treatment.

7. The method of claim 1, wherein the step of generating a flow of the polishing mixture along the airfoil portion comprises advancing the metal particles of the polishing mixture along the pressure side and the suction side of the airfoil portion.

8. The method of claim 1, wherein the machine component is a blade or bucket of an axial turbomachine, having a root and a tip, wherein the airfoil portion extends between the root and the tip, an airfoil chord being defined between the trailing edge and the leading edge in each position of the airfoil portion from the root to the tip, and wherein a length of the chord is maintained substantially unaltered during the step of vibrating the machine component until a final arithmetic average roughness of 0.3 μm or less is achieved.

9. The method of claim 8, wherein the final arithmetic average roughness is 0.17 μm or less.

10. The method of claim 8, wherein during the step of vibrating the machine component the chord length is varied by less than 0.05%.

11. The method of claim 8, wherein during the step of vibrating the machine component the chord length is reduced by not more than 0.1 mm.

12. The method of claim 11, wherein during the step of vibrating the thickness of the blades of the impeller is reduced by less than 0.5% on average.

13. The method of claim 11, wherein during the step of vibrating the thickness of the blades of the impeller is reduced by not more than 0.1 mm.

14. The method of claim 11, wherein during the step of vibrating the machine component the diameter of the central drive-shaft receiving bore is varied by less than 0.05%.

15. The method of claim 11, wherein the impeller comprises a shroud comprised of an impeller eye; the impeller eye has an outer surface with at least one cylindrical outer surface portion; and during the step of vibrating the machine component, the diameter of the cylindrical outer surface portion remains substantially unaltered when the final arithmetic average roughness achieved on an inner surface of the vanes is equal to or less than 0.3 μm.

16. The method of claim 15, wherein during the step of vibrating the machine component a diameter of the cylindrical outer surface portion is varied by less than 0.01%.

17. The method of claim 15, wherein the hub, the shroud and adjacent impeller blades define flow vanes therebetween, each flow vane having an outlet aperture at the trailing edges of the blades, and wherein during the step of vibrating a axial dimension of the outlet apertures varies on average less than 0.05%.

18. The method of claim 11, wherein the impeller is an un-shrouded impeller and wherein the method further comprises the step of applying an impeller closure, closing the vanes along tips of the blades before adding the polishing mixture in the container.

19. The method of claim 1, wherein the machine component is a turbomachine impeller comprising a hub with a central drive-shaft receiving bore and a plurality of blades arranged on the hub around the drive-shaft receiving bore, vanes being defined between adjacent blades, each vane having an inlet and an outlet, each blade having a leading edge at the inlet and a trailing edge at the outlet of adjacent vanes, and wherein vibrating the machine component causes the polishing mixture flow to circulate in the vanes.

20. The method of claim 19, wherein during the step of vibrating the machine component an inner diameter of the central drive-shaft receiving bore remains substantially unaltered when the final arithmetic average roughness achieved on the inner surface of the vanes is equal to or less than 0.3 μm.

21. The method of claim 1, wherein the metal particles comprise metal chips.

22. The method of claim 1, wherein the metal particles comprise copper particles.

23. The method of claim 1, wherein the abrasive powder is aluminum oxide, ceramic or a combination thereof.

24. The method of claim 1, wherein the liquid comprises water.

25. The method of claim 24, wherein the liquid comprises water and a polishing medium.

26. The method of claim 1, wherein the polishing mixture has the following composition by weight:

metal particles 90-98% abrasive powder 0.05-0.4% liquid 3-10%.

27. The method of claim 1, wherein the step of vibrating the container and the machine component constrained thereto lasts between 5 and 8 hours.

28. The method of claim 1, wherein the step of vibrating the container and the machine component constrained thereto lasts between 1.5 and 10 hours.

* * * * *